US009586405B2

(12) United States Patent
Iwamuro et al.

(10) Patent No.: US 9,586,405 B2
(45) Date of Patent: Mar. 7, 2017

(54) INK SUPPLY APPARATUS

(71) Applicant: SEIKO EPSON CORPORATION, Tokyo (JP)

(72) Inventors: Takeshi Iwamuro, Nagano (JP); Masaru Takahashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/818,564

(22) Filed: Aug. 5, 2015

(65) Prior Publication Data

US 2015/0336391 A1 Nov. 26, 2015

Related U.S. Application Data

(63) Continuation of application No. 14/011,882, filed on Aug. 28, 2013, now Pat. No. 9,126,414.

(30) Foreign Application Priority Data

Aug. 31, 2012 (JP) ..... 2012-190746

(51) Int. Cl.
*B41J 2/175* (2006.01)

(52) U.S. Cl.
CPC ..... *B41J 2/17503* (2013.01); *B41J 2/175* (2013.01)

(58) Field of Classification Search
CPC ..... B41J 2/175; B41J 2/17503
USPC ..... 347/85
See application file for complete search history.

(56) References Cited

U.S. PATENT DOCUMENTS 4,122,457 A 10/1978 Erikson et al.
4,977,413 A 12/1990 Yamanaka et al.
5,751,319 A * 5/1998 Robertson ..... B41J 2/17509 347/85
5,886,719 A 3/1999 Zepeda
6,065,829 A * 5/2000 Ruiz ..... B41J 2/17509 347/85
6,145,968 A * 11/2000 Fries ..... B41J 2/17523 347/85
6,158,851 A 12/2000 Zepeda
6,283,586 B1 * 9/2001 Childers ..... B41J 2/16538 347/85
6,338,553 B1 * 1/2002 Lewis ..... B41J 11/001 347/85
6,378,971 B1 4/2002 Tamura et al.
6,390,611 B1 5/2002 Kobayashi et al.
6,416,166 B1 7/2002 Robinson et al.
6,431,699 B2 * 8/2002 Shihoh ..... 347/86
(Continued)

FOREIGN PATENT DOCUMENTS

CN 2875810 Y 3/2007
CN 101304882 A 11/2008
(Continued)

*Primary Examiner* — Stephen Meier
*Assistant Examiner* — Alexander D Shenderov
(74) *Attorney, Agent, or Firm* — Global IP Counselors, LLP

(57) ABSTRACT

An ink supply apparatus is an apparatus for supplying ink to a printer, the printer including a holder provided with an ink receiving part. The ink supply apparatus includes an ink supply passage member connected to the ink receiving part, and an ink container in fluid communication with the ink receiving part through the ink supply passage member. The ink container including an ink discharge port at an upper portion thereof.

6 Claims, 20 Drawing Sheets

(56) References Cited

U.S. PATENT DOCUMENTS

| | | | | |
|---|---|---|---|---|
| 8,141,998 | B2 | 3/2012 | Nozawa et al. | |
| 2005/0068385 | A1 | 3/2005 | Nanjo et al. | |
| 2005/0134636 | A1 | 6/2005 | Matsuba et al. | |
| 2006/0187280 | A1* | 8/2006 | Yan | B41J 2/17506 347/85 |
| 2007/0030320 | A1* | 2/2007 | Van Roy | B41J 2/17503 347/85 |
| 2007/0109368 | A1 | 5/2007 | Kimura | |
| 2008/0309738 | A1* | 12/2008 | Yan | B41J 2/175 347/85 |
| 2009/0179974 | A1 | 7/2009 | Kimura | |
| 2012/0200646 | A1 | 8/2012 | Karasawa et al. | |
| 2012/0212526 | A1 | 8/2012 | Karasawa et al. | |
| 2013/0278687 | A1 | 10/2013 | Karasawa et al. | |

FOREIGN PATENT DOCUMENTS

| | | | |
|---|---|---|---|
| CN | 201580053 | U | 9/2010 |
| JP | 10-000789 | A | 1/1998 |
| JP | 2003-072102 | A | 3/2003 |
| JP | 2004-358802 | A | 12/2004 |
| JP | 2008-273173 | A | 11/2008 |
| JP | 2009-172858 | A | 8/2009 |
| JP | 2010-155465 | A | 7/2010 |
| JP | 2010-240971 | A | 10/2010 |
| JP | 2012-144037 | A | 8/2012 |
| WO | 2007/037546 | A1 | 4/2007 |

* cited by examiner

INK SUPPLY APPARATUS

CROSS-REFERENCE TO RELATED APPLICATIONS

This application is a continuation application of U.S. patent application Ser. No. 14/011,882 filed on Aug. 28, 2013. This application claims priority to Japanese Patent Application No. 2012-190746 filed on Aug. 31, 2012. The entire disclosures of U.S. patent application Ser. No. 14/011,882 and Japanese Patent Application No. 2012-190746 are hereby incorporated herein by reference.

BACKGROUND

Technical Field

The present invention relates to an ink supply apparatus.

Related Art

Ink supply apparatuses are mounted into printers and supply ink to the printers. An ink cartridge which is configured so as to be able to be attached and detached with regard to the printer is known as an example of an ink supply apparatus. The ink cartridge is provided with an ink storage section which stores ink and the ink cartridge supplies the ink from the ink storage section to the printer in a state of being mounted into the printer. In a case of a low ink remaining state where the remaining amount of the ink in the ink storage section is a predetermined amount or less, the ink cartridge is replaced with a new ink cartridge by the user.

Japanese Unexamined Patent Application Publication No. 2008-273173 describes detecting the low ink remaining amount state of the ink in the ink cartridge at the printer side by detecting pressure variations in the ink in the ink storage section using a piezoelectric element (a sensor) which is mounted into the ink cartridge. Japanese Unexamined Patent Application Publication No. 2010-155465 describes detecting the low ink remaining amount state of the ink in the ink cartridge at the printer side by an arm, which is linked with the liquid surface of the ink in the ink storage section, being provided in the ink cartridge and the position of the arm being detected using an optical sensor which is provided on the printer side.

An ink supply apparatus which is referred to as a continuous ink supply system (CISS) which is configured to be able to continuously supply the ink and an ink supply apparatus which is configured so as to be able to be refilled (refillable), which are different to ink cartridges which are replaced in a case of having reached the low ink remaining amount state, are also known as other examples of the ink supply apparatus. An ink filling port which receives filling of ink is provided in such ink supply apparatuses.

SUMMARY

In the technique of Japanese Unexamined Patent Application Publication No. 2008-273173, there are problems such as an increase in the cost of the cartridges and complexity of the electrical configuration in the cartridges since the sensor which detects the low ink remaining amount state of the ink is provided in the cartridge.

In the technique of Japanese Unexamined Patent Application Publication No. 2010-155465, it was necessary to maintain the positional relationship of the optical sensor at the printer side and the arm at the ink cartridge side with high precision, and there are problems such as detection failure due to positional deviation of the ink cartridge and complexity of the structure for preventing the positional deviation.

In addition, sufficient consideration was not given to detection of the low ink remaining amount state of the ink in an ink supply apparatus which is provided with the ink filling port. Moreover, size reduction, cost reduction, resource saving, ease of manufacturing, improved usability, and the like are desirable in the ink supply apparatus. Here, the problems described above are not limited to the ink supply apparatus but are common to liquid supply apparatuses which supply other liquids to liquid consuming apparatuses.

The present invention was created in order to solve at least a portion of the problems described above and is able to be realized in the following forms.

An ink supply apparatus according to one aspect is an apparatus for supplying ink to a printer, the printer including a holder provided with an ink receiving part. The ink supply apparatus includes an ink supply passage member connected to the ink receiving part, and an ink container in fluid communication with the ink receiving part through the ink supply passage member. The ink container including an ink discharge port at an upper portion thereof

BRIEF DESCRIPTION OF THE DRAWINGS

Referring now to the attached drawings which form a part of this original disclosure.

DETAILED DESCRIPTION OF EXEMPLARY EMBODIMENTS

Contents

A. First Embodiment
A-1. Overall Configuration of Printing System
A-2. Detailed Configuration of Cartridge
A-3. Detailed Configuration of Holder
A-4. Effects
B. Second Embodiment
C. Third Embodiment
D. Fourth Embodiment
E. Other Embodiments

A. First Embodiment

A-1. Overall Configuration of Printing System

Figure 1:
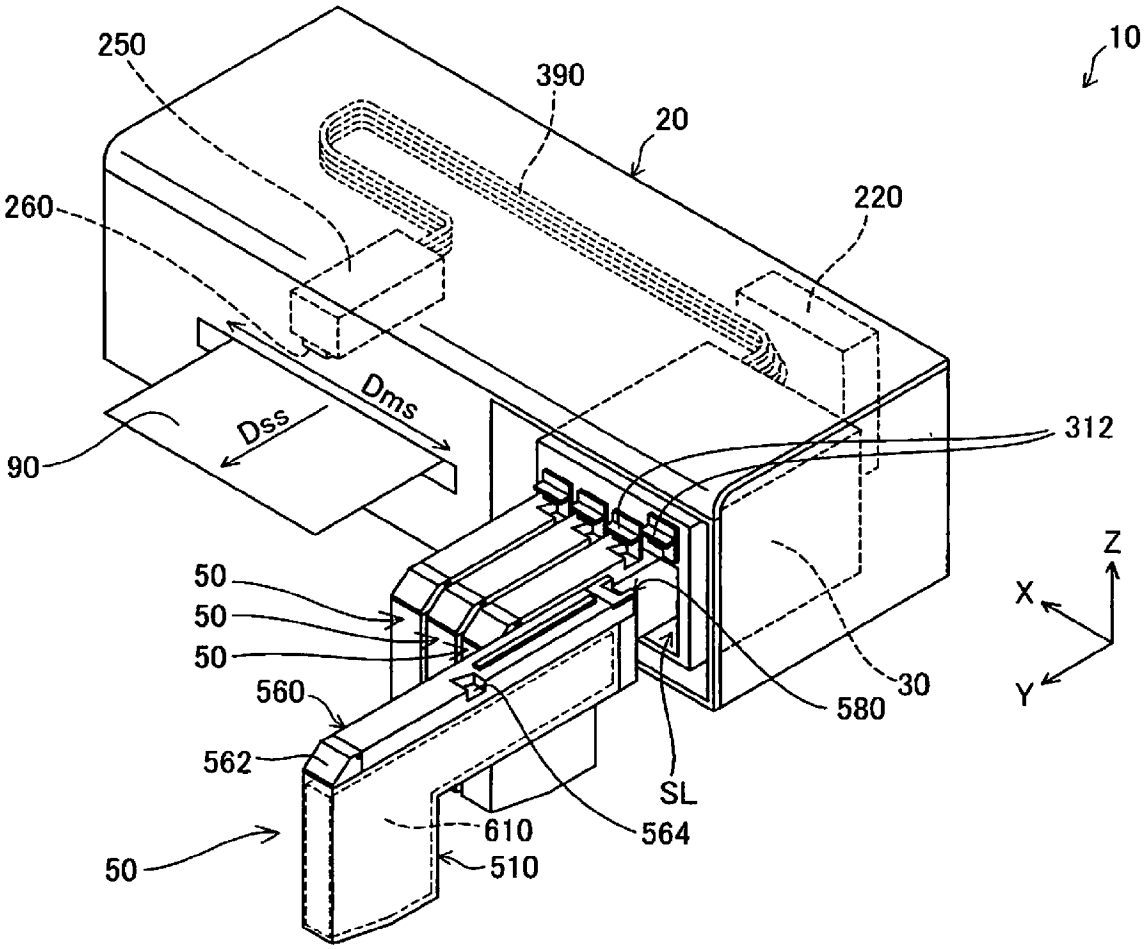
FIG. 1 is a perspective diagram illustrating a configuration of a printing system.

FIG. 1 is a perspective diagram illustrating a configuration of a printing system 10. The printing system 10 is provided with a printer 20 and a cartridge 50. In the printing system 10, in a state where the cartridge 50 is mounted into a holder 30 which is provided in the printer 20, the cartridge 50 supplies ink (a printing material) to the printer 20 and the printer 20 executes printing using the ink which is supplied from the cartridge 50.

The holder 30 of the printer 20 is a holding apparatus which holds the cartridge 50. A slot SL, which is a region where insertion of the cartridge 50 is received, is formed in the holder 30. In the present embodiment, one slot SL is configured so as to be able to receive the insertion of one cartridge 50. In the present embodiment, one engaging section 312 is provided with regard to one slot SL in the holder 30. The engaging section 312 of the holder 30 is configured so as to be able to engage with the cartridge 50 which is inserted into the slot SL and prevents the cartridge 50 from being accidentally detached from the slot SL.

In the present embodiment, four types of the cartridge 50 which correspond to four colors (black, yellow, magenta, and cyan) of ink, that is, four of the cartridges 50, are mounted one at a time into the holder 30. The number of the cartridges 50 which are able to be mounted into the holder 30 is not limited to four, it is possible to alter the number to any arbitrary number, and the number of the cartridges 50 may be less than four or may be greater than four. The inks in the cartridges 50 are not limited to four colors and may be less than four colors or may be five or more colors, and may be inks of other colors (for example, light magenta, light cyan, or the like) or special glossy colors (metallic gloss, pearl white ink, or the like). In other embodiments, it is possible for the holder 30 to be mounted with two or more of the cartridges 50 which correspond to inks of the same type. The configuration of the holder 30 will be described in detail later.

The printer 20 in the printing system 10 is a printing apparatus which performs printing using ink and is an ink jet printer in the present embodiment. The printer 20 is provided with a control section 220, a carriage 250, and a head 260 along with the holder 30. The printer 20 prints information such as text, graphics and images on a printing medium 90 such as paper or a label by discharging ink from the head 260 with regard to the printing medium 90.

In the printer 20, the holder 30 is provided at a location which is different to the carriage 250, and ink is supplied from the holder 30 where the cartridge 50 is mounted via a flexible tube 390 into the head 260 which is provided in the carriage 250. Due to this, the mechanism of the printer 20 where the holder 30 is provided at a location which is different to the carriage 250 is also referred to as an off-carriage type.

The control section 220 of the printer 20 controls each of the sections of the printer 20. In the present embodiment, the control section 220 has a control circuit which is formed using an ASCI (Application Specific Integrated Circuit). The carriage 250 of the printer 20 is configured so that the head 260 is able to relatively move with regard to the printing medium 90. The head 260 of the printer 20 receives the supply of ink from the cartridge 50 which is mounted into the holder 30 and discharges the ink with regard to the printing medium 90. In the present embodiment, the control section 220 and the carriage 250 are electrically connected via a flexible cable (which is not shown in the diagram) and the head 260 executes the discharging of the ink based on a control signal from the control section 220.

In the present embodiment, in order to realize the printing with regard to the printing medium 90 by relatively moving the carriage 250 and the printing medium 90, the printer 20 is configured to be able to reciprocally move the carriage 250 along a main scanning direction Dms and configured to be able to transport the printing medium 90 along a sub-scanning direction Dss. In the present embodiment, the main scanning direction Dms and the sub-scanning direction Dss are orthogonal to each other and are each orthogonal with regard to the direction of gravity. The printer 20 is realized based on the control of the movement of the carriage 250 and the transport of the printing medium 90 by the control section 220.

The XYZ axes are shown in FIG. 1. The XYZ axes in FIG. 1 correspond to the XYZ axes in the other diagrams. In the present embodiment, in a state where the printing system 10 is being used, the axis along the main scanning direction Dms where the carriage 250 is reciprocally moved is the X axis, the axis along the sub-scanning direction Dss where the printing medium 90 is transported is the Y axis, and the axis along the direction of gravity is the Z axis. The X axis, Y axis, and Z axis are orthogonal to each other. The state where the printing system 10 is being used is a state where the printing system 10 is set on a flat surface and the XY plane where the X axis and the Y axis are parallel is the horizontal plane in the present embodiment.

In the present embodiment, the alignment direction of a plurality of the cartridges 50 which are mounted into the holder 30 is the direction along the X axis. In other embodiments, the alignment direction of the plurality of cartridges 50 may be the direction along the Y axis, may be the direction along the Z axis, or may be a direction which is inclined with regard to at least one axis of the X axis, the Y axis, and the Z axis.

In the present embodiment, from the right side surface of the printing system 10 toward the left side surface is the +X axis direction and the opposite direction to the +X axis direction is the −X axis direction. In the present embodiment, toward the sub-scanning direction is the +Y axis direction and the opposite direction to the +Y axis direction is the −Y axis direction. In the present embodiment, toward the direction opposite to gravity is the +Z axis direction and the direction of gravity which follows gravity is the −Z axis direction. In the present embodiment, the +Y axis direction side is the front surface of the printing system 10.

The cartridge 50 of the printing system 10 is an ink supply apparatus which supplies ink to the printer 20 and is an ink supply apparatus which is able to be refilled with ink (refillable) in the present embodiment. As shown in FIG. 1, in the present embodiment, the cartridge 50 is formed in an approximate L shape and is mounted into the holder 30 in a state where the long side in the approximate L shape is directed toward the −Y axis direction and the short side in the approximate L shape is directed toward the −Z axis direction.

Figure 2:
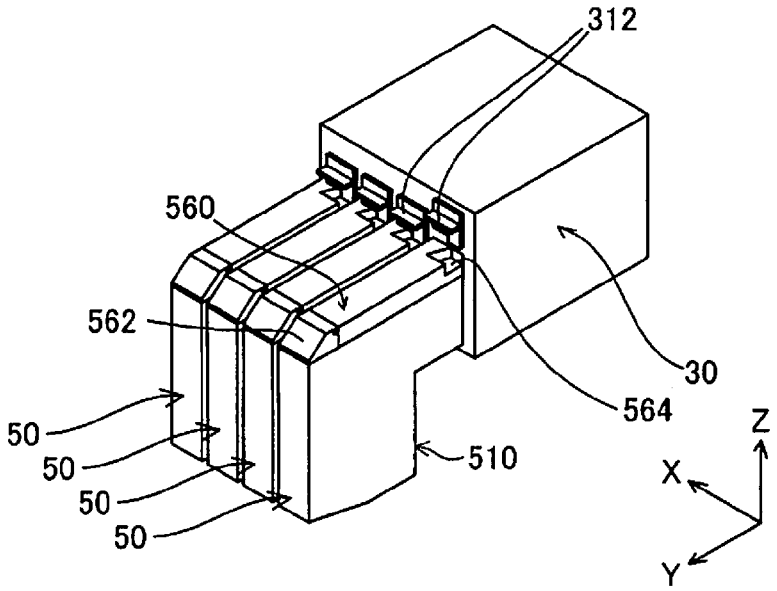
FIG. 2 is a perspective diagram illustrating a state where a cartridge is mounted into a holder.

The cartridge 50 is configured so as to be able to be attached and detached with regard to the holder 30. FIG. 1 illustrates a state where the cartridge 50 on the −X axis direction side out of the four cartridges 50 is detached from the holder 30. FIG. 2 is a perspective diagram illustrating a state where the cartridge 50 is mounted into the holder 30. FIG. 2 illustrates a state where all four of the cartridges 50 are mounted into the holder 30.

In the present embodiment, it is possible for the user of the printing system 10 to mount the cartridge 50 with regard to the holder 30 by moving the cartridge 50 in the −Y axis direction with regard to the slot SL of the holder 30. In the present embodiment, it is possible for the user of the printing system 10 to detach the cartridge 50 from the holder 30 by moving the cartridge 50 in the +Y axis direction in a state where the engagement with the cartridge 50 using the engaging section 312 is released (for example, the state of the engaging section 312 on the −X axis direction side in FIG. 2).

The cartridge 50 is provided with a housing 510, a slider (a sliding member) 560, and a circuit member 580. As shown in FIG. 1, the housing 510 of the cartridge 50 is a box where an ink storage section 610 which stores the ink is provided in the inner section.

Figure 3:
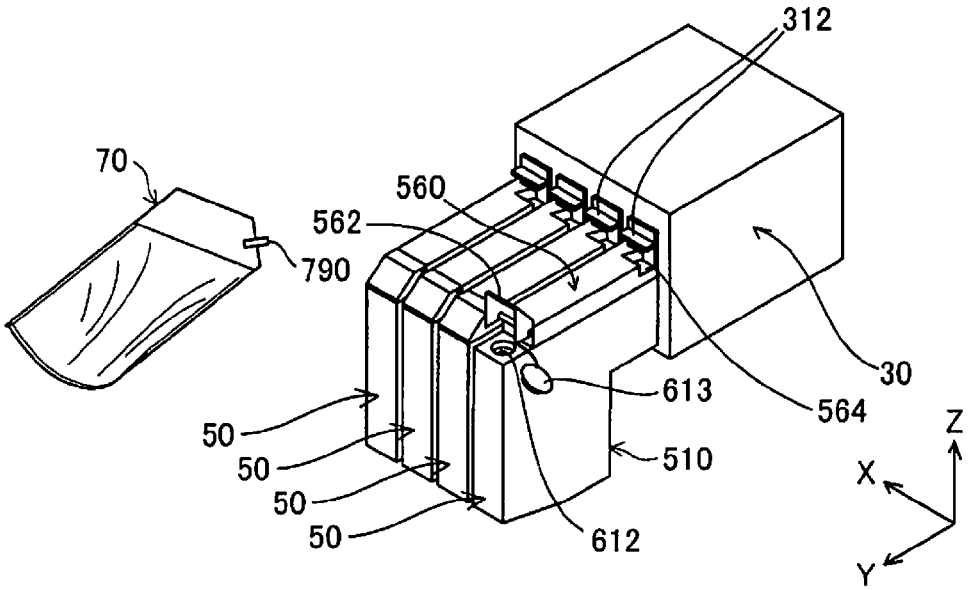
FIG. 3 is a perspective diagram illustrating a state where ink is refilled into a cartridge which is mounted into a holder.
Figure 4:
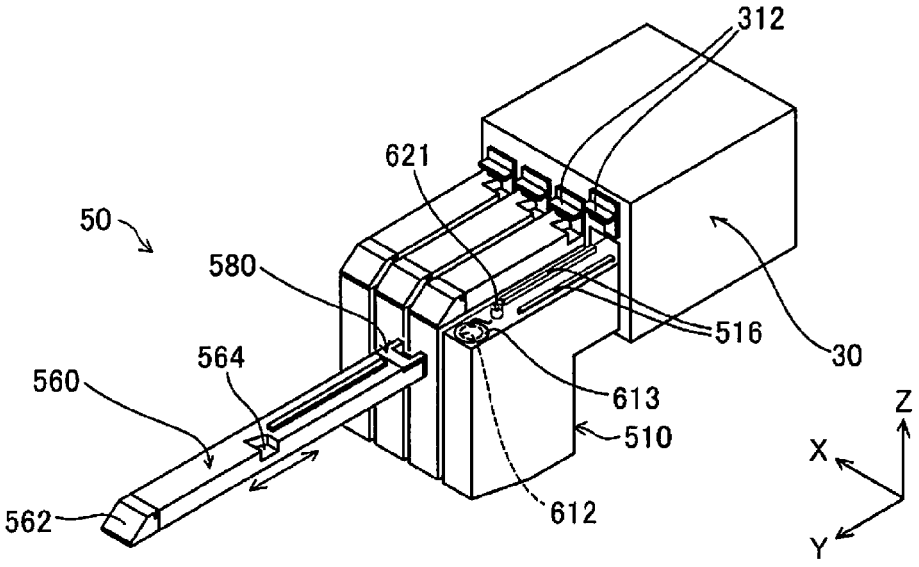
FIG. 4 is a perspective diagram illustrating a state where a slider in a cartridge which is mounted into a holder is detached.

FIG. 3 is a perspective diagram illustrating a state where the ink is refilled into the cartridge 50 which is mounted into the holder 30. FIG. 4 is a perspective diagram illustrating a state where the slider 560 in the cartridge 50 which is mounted into the holder 30 is removed. As shown in FIGS. 3 and 4, an ink filling port 612, a lid 613, an atmosphere opening port 621, and a rail 516 are provided in the housing 510 along with the ink storage section 610. The ink filling port 612 is an opening which is linked with the ink storage section 610 and receives inflow of ink with regard to the ink storage section 610. The lid 613 is configured so as to be able to attached and detached with regard to the ink filling port 612 and seals the ink filling port 612 in a state of being mounted into the ink filling port 612. The atmosphere opening port 621 is an opening which is linked with the ink storage section 610 and opens the ink storage section 610 to the atmosphere. The rail 516 guides the sliding of the slider 560.

As shown in FIG. 4, the slider 560 of the cartridge 50 is configured so as to be able to be attached and detached by sliding (sliding movement) with regard to the housing 510 which is mounted into the holder 30 in a state where the circuit member 580 is mounted. In the present embodiment, the slider 560 is provided with a lid section 562, and a concave section 564. The lid section 562 of the slider 560 is configured so as to cover the ink filling port 612 in a state where the slider 560 is mounted into the housing 510. In the present embodiment, the lid section 562 is pivotally attached at a position which corresponds to the +Z axis direction side of the ink filling port 612 and configured so as to be able to open and close a region on the +Z axis direction side of the ink filling port 612. The concave section 564 of the slider 560 is configured so as to be able to engage with the engaging section 312 of the holder 30.

The circuit member 580 of the cartridge 50 is mounted with a circuit element, which is configured to be able to store information which relates to ink, and is configured so as to be able to be attached and detached with regard to the slider 560. The configuration of the circuit member 580 will be described in detail later.

When refilling the ink into the ink storage section 610 of the cartridge 50, the user of the printing system 10 opens the lid section 562 of the slider 560 and then detaches the lid 613 from the ink filling port 612 of the housing 510 as shown in FIG. 3. After that, the user prepares an ink container 70 which stores ink for refilling and the ink flows into the ink filling port 612 of the cartridge 50 from a discharge port 790 of the ink container 70 until the ink is sufficiently full in the ink storage section 610. After that, the user seals the ink filling port 612 with the lid 613 and closes the lid section 562. Due to this, the refilling of the ink is completed.

In the present embodiment, a new circuit member 580 which handles information which relates to ink to be refilled using the ink container 70 belongs with the ink container 70, and the circuit member 580 is replaced by the user of the printing system 10 in accordance with the refilling of the ink from the ink container 70 with regard to the cartridge 50. The replacement of the circuit member 580 may be before the refilling of the ink or may be after the refilling of the ink.

When replacing the circuit member 580, the user of the printing system 10 detaches the slider 560 from the holder 30 while maintaining the mounting of the housing 510 with regard to the holder 30 by moving the slider 560 in the +Y axis direction in a state where the engagement using the engaging section 312 is released as shown in FIG. 4. After that, the user replaces the old circuit member 580 which was mounted into the slider 560 with the new circuit member 580 which belongs with the ink container 70. After that, the user moves the slider 560 where the new circuit member 580 is mounted to the −Y axis direction side with regard to the housing 510. Due to this, the replacement of the circuit member 580 is completed when the slider 560 is mounted into the original position. In the present embodiment, when removing the slider 560, it is possible for the user to easily detach the slider 560 by hooking a finger into the concave section 564 and moving the slider 560 in the +Y axis direction.

A-2. Detailed Configuration of Cartridge

Figure 5:
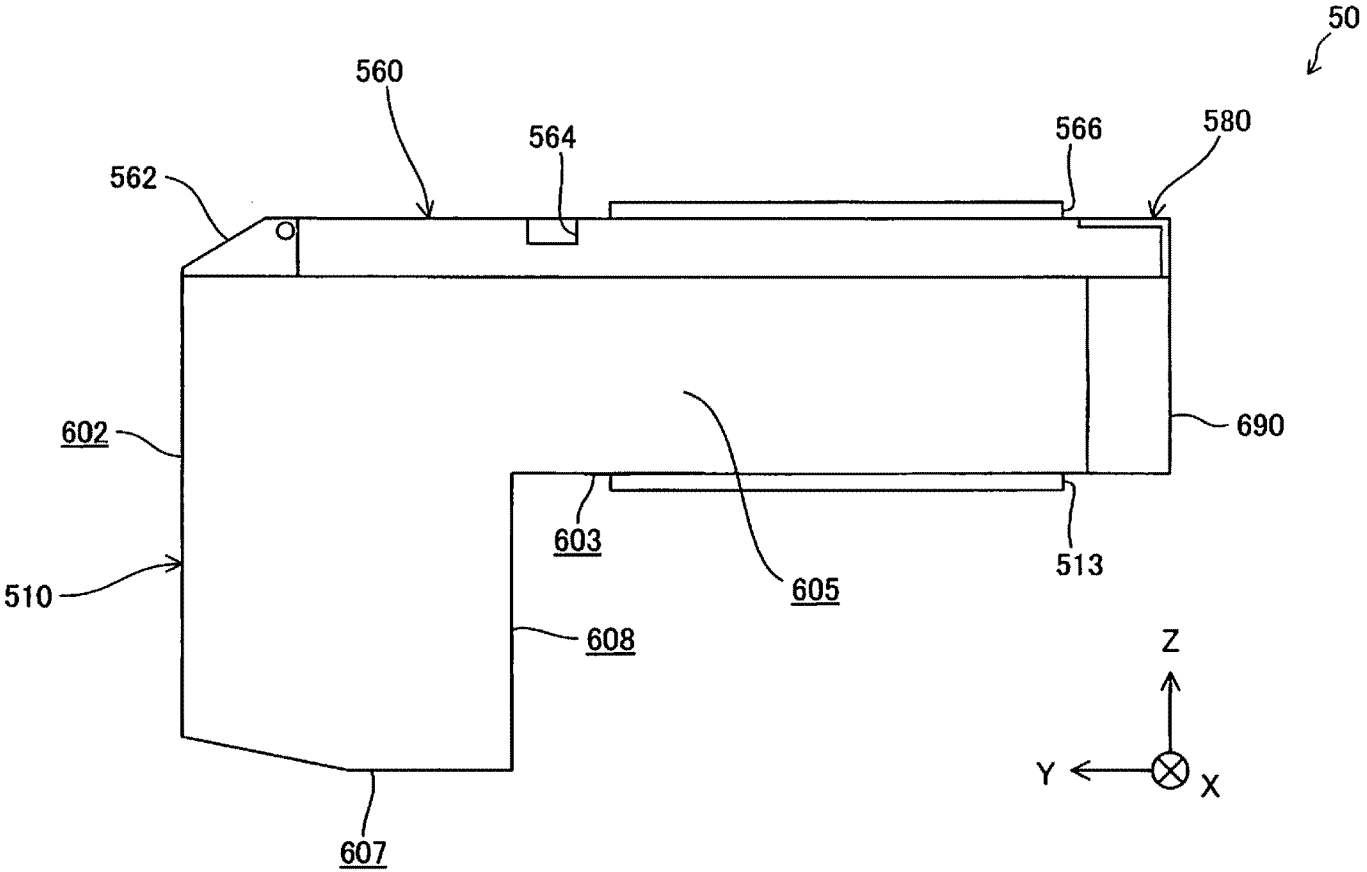
FIG. 5 is a right side surface diagram illustrating a configuration of a cartridge.
Figure 6:
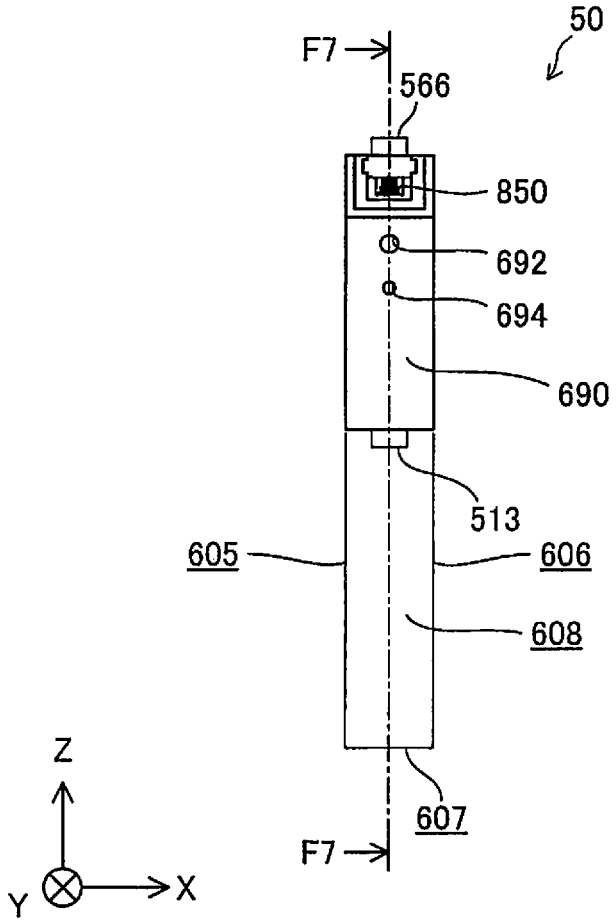
FIG. 6 is a rear surface diagram illustrating a configuration of a cartridge.
Figure 7:
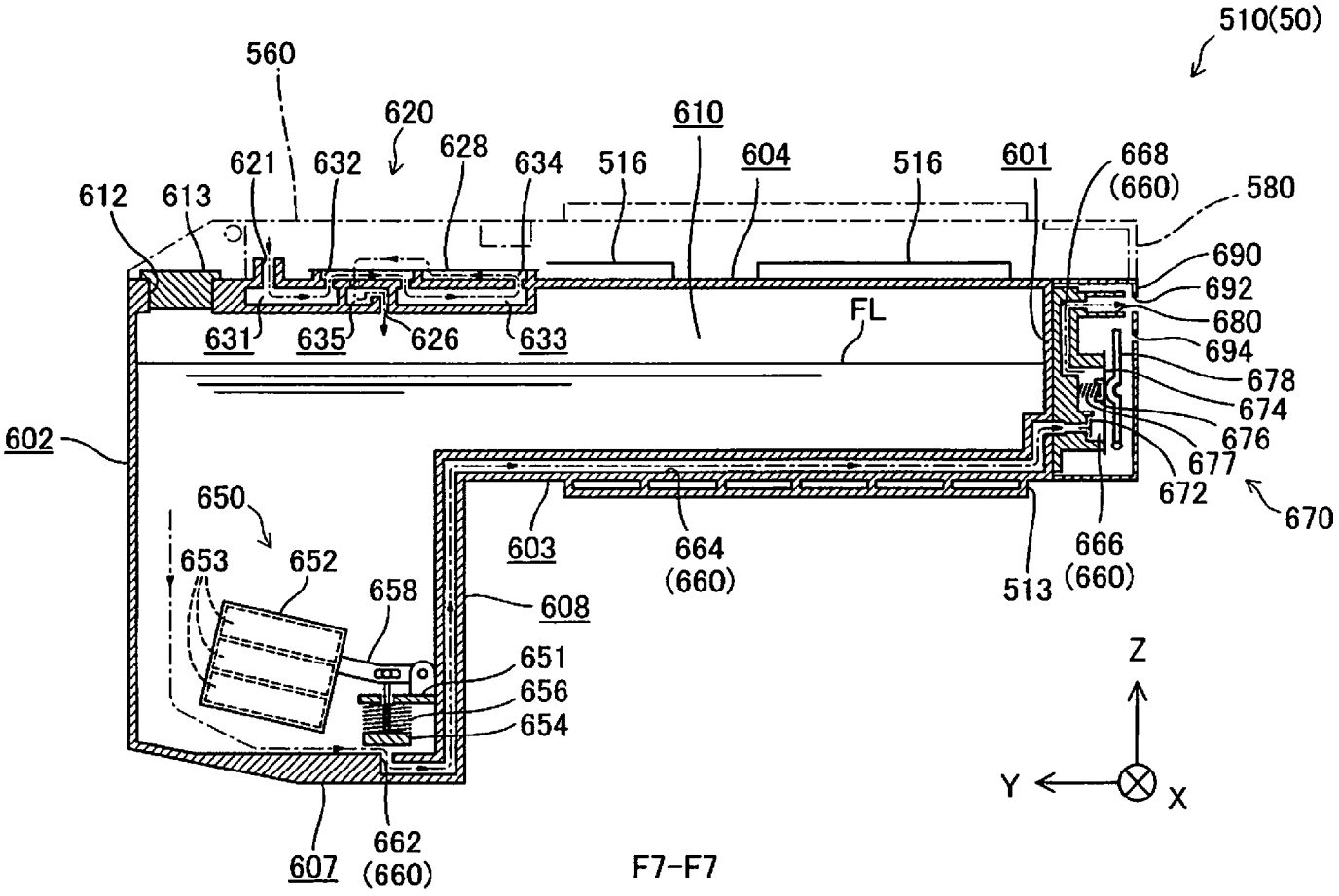
FIG. 7 is a cross sectional diagram illustrating a configuration of a cartridge.

FIG. 5 is a right side surface diagram illustrating a configuration of the cartridge 50. FIG. 6 is a rear surface diagram illustrating a configuration of the cartridge 50. FIG. 7 is a cross sectional diagram illustrating a configuration of the cartridge 50. In FIG. 7, the housing 510 in the cartridge 50 which is a cut away along the arrow line F7-F7 in FIG. 6 is illustrated using a solid line and the outer shapes of the slider 560 and the circuit member 580 are illustrated using a dashed line.

In the description of the cartridge 50, the axes of the X axis, the Y axis, and the Z axis with regard to the cartridge 50 in the mounted state of being mounted into the holder 30 are each axes on the cartridge 50. In the present embodiment, in a state where the cartridge 50 is mounted into the holder 30, the +Y axis direction side is the front surface of the cartridge 50. In the present embodiment, the mounting direction when the cartridge 50 is mounted into the holder 30 is the −Y axis direction.

As described above, the cartridge 50 is provided with the housing 510, the slider 560, and the circuit member 580. In the present embodiment, in the cartridge 50, the slider 560 is attached at the +Z axis direction side of the housing 510 and the circuit member 580 is attached at the −Y axis direction side of the slider 560.

In the present embodiment, a convex ridge section 513 and a convex ridge section 566 are provided in the cartridge 50. The convex ridge section 513 is at a location which is provided in the housing 510, is continuous in the Y axis direction, and protrudes in the −Z axis direction, and the convex ridge section 513 is engaged with the holder 30. The convex ridge section 566 is at a location which is provided in the slider 560, is continuous in the Y axis direction, and protrudes in the +Z axis direction, and the convex ridge section 566 is engaged with the holder 30.

As shown in FIG. 5, the housing 510 of the cartridge 50 is formed in an approximate L shape and the long side in the approximate L shape is directed towards the −Y axis direction and the short side in the approximate L shape is directed towards the −Z axis direction. As shown in FIG. 7, the shape of the ink storage section 610 which is provided in the inner section of the housing 510 is formed in an approximate L shape in the same manner as the shape of the housing 510. The housing 510 and the ink storage section 610 are not limited to the approximate L shape and may be shapes which are based on a rectangle or may be shapes where a portion is configured by a curved surface or an inclined surface, and it is possible for the housing 510 and the ink storage section 610 to be appropriately realized using a variety of shapes.

As shown in FIGS. 5 to 7, the housing 510 is provided with a first wall surface 601, a second wall surface 602, a third wall surface 603, a fourth wall surface 604, a fifth wall surface 605, a sixth wall surface 606, a seventh wall surface 607, and an eighth wall surface 608 as wall surfaces which partition the ink storage section 610. As shown in FIG. 7, the ink storage section 610 is formed at the inner side of the first to eighth wall surfaces 601 to 608.

The first to eighth wall surfaces 601 to 608 are formed to be flat as a general shape but it is not necessary for all of the surfaces to be completely flat and a portion of the surface may have irregularities. In the present embodiment, the first to eighth wall surfaces 601 to 608 are surfaces which configure an assembly where a plurality of members are assembled. In the present embodiment, the first to eighth wall surfaces 601 to 608 are formed of plate members and a portion of the wall surfaces may be formed by a film member (with a thin film shape). The first to eighth wall surfaces 601 to 608 are formed of synthetic resins which have ink impermeability and airtightness (for example, polypropylene and polyacetal (POM)).

The first wall surface 601 in the housing 510 partitions the −Y axis direction side of the ink storage section 610 in the +Z axis direction. The first wall surface 601 is a wall surface which is parallel to the Z axis and the Y axis and is in a positional relationship which faces the second wall surface 602 in the Y axis direction.

The second wall surface 602 in the housing 510 partitions the +Y axis direction side of the ink storage section 610. The second wall surface 602 is a wall surface which is parallel to the Z axis and the Y axis and is in a positional relationship which faces the first wall surface 601 and the eighth wall surface 608 in the Y axis direction.

The third wall surface 603 in the housing 510 partitions the −Z axis direction side of the ink storage section 610 in the −Y axis direction. The third wall surface 603 is a wall surface which is parallel to the X axis and the Y axis and is in a positional relationship which faces the fourth wall surface 604 in the Z axis direction. In the present embodiment, the convex ridge section 513 is provided at the outer side (the −Z axis direction side) of the third wall surface 603.

The fourth wall surface 604 in the housing 510 partitions the +Z axis direction side of the ink storage section 610. The fourth wall surface 604 is a wall surface which is parallel to the X axis and the Y axis and is in a positional relationship which faces the third wall surface 603 and the seventh wall surface 607 in the Z axis direction. The outer side (the +Z axis direction side) of the fourth wall surface 604 is configured so as to be able to attach the slider 560 and the circuit member 580 and the rail 516 is provided on the outer side of the fourth wall surface 604 in the present embodiment as shown in FIG. 7.

The fifth wall surface 605 in the housing 510 is formed in an approximate L shape and partitions the −X axis direction side of the ink storage section 610. The fifth wall surface 605 is a wall surface which is parallel to the Y axis and the Z axis and is in a positional relationship which faces the sixth wall surface 606 in the X axis direction.

The sixth wall surface 606 in the housing 510 is formed in an approximate L shape and partitions the +X axis direction side of the ink storage section 610. The sixth wall surface 606 is a wall surface which is parallel to the Y axis and the Z axis and is in a positional relationship which faces the fifth wall surface 605 in the X axis direction.

The seventh wall surface 607 in the housing 510 partitions the −Z axis direction side of the ink storage section 610 in the +Y axis direction. The seventh wall surface 607 is a wall surface which is parallel to the X axis and the Y axis and is in a positional relationship which faces the fourth wall surface 604 in the X axis direction at the −Z axis direction side of the third wall surface 603.

The eighth wall surface 608 in the housing 510 partitions the −Y axis direction side of the ink storage section 610 in the −Z axis direction. The eighth wall surface 608 is a wall surface which is parallel to the Z axis and the X axis and is in a positional relationship which faces the second wall surface 602 in the Y axis direction at the +Y axis direction side of the first wall surface 601.

As shown in FIGS. 5 to 7, the housing 510 is provided with an atmosphere opening structure 620, a float valve 650, an ink flow path 660, a displacement section 670, an ink supply port 680, and a cover 690 along with the ink filling port 612 described above.

As described above, the ink filling port 612 of the housing 510 is an opening which receives the filling of ink which is refilled into the ink storage section 610. In the present embodiment, the ink filling port 612 is provided at the −Y axis direction side of the fourth wall surface 604. In the present embodiment, the ink filling port 612 is configured so as to be able to be sealed by the lid 613 as described above. In the present embodiment, the ink filling port 612 is covered by the lid section 562 which is provided in the slider 560 in a state where the slider 560 is mounted into the housing 510 as described above.

The atmosphere opening structure 620 of the housing 510 is a structure which opens the ink storage section 610 to the atmosphere through the atmosphere opening port 621 described above. In the present embodiment, the atmosphere opening structure 620 is provided in the fourth wall surface 604 at the −Y axis direction side of the ink filling port 612. In the present embodiment, the atmosphere opening structure 620 is covered by the slider 560 in a state where the slider 560 is mounted into the housing 510.

Figure 8A:
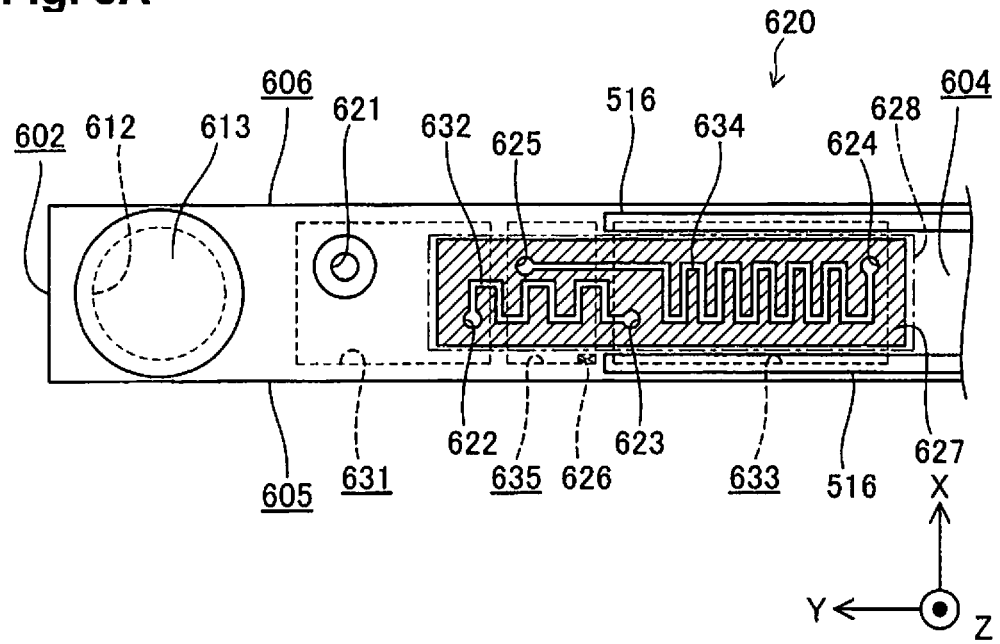
FIGS. 8A and 8B are explanatory diagrams illustrating a detailed configuration of an atmosphere opening structure.
Figure 8B:
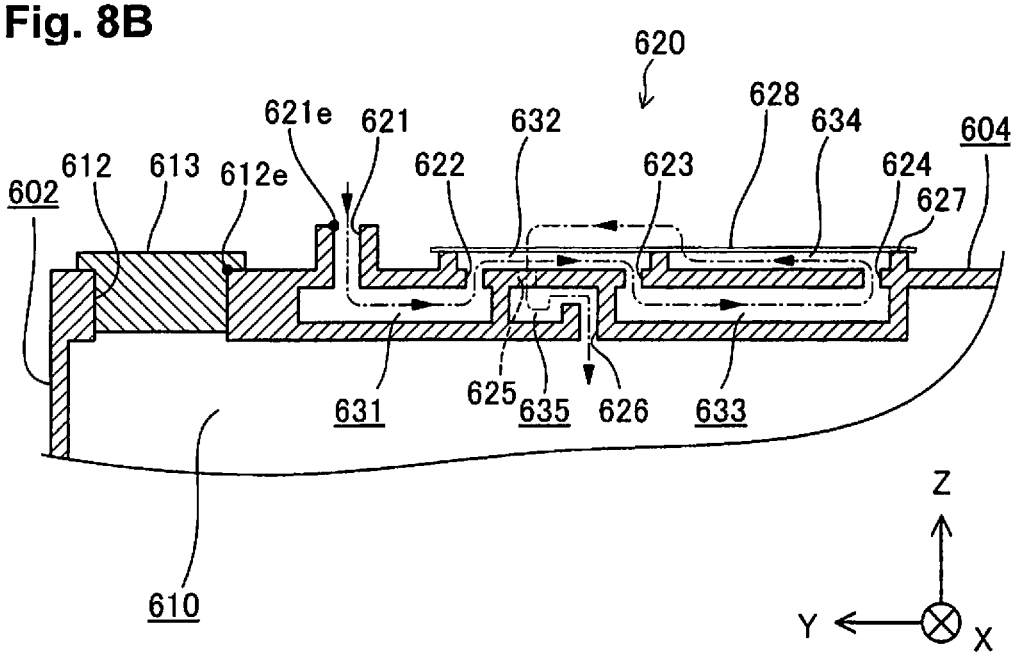

FIGS. 8A and 8B are explanatory diagrams illustrating a detailed configuration of the atmosphere opening structure 620. FIG. 8A which is shown in the upper part of FIG. 8 illustrates the atmosphere opening structure 620 as viewed from the +Z axis direction side. FIG. 8B which is shown in the lower part of FIG. 8 schematically illustrates a cross sectional configuration of the atmosphere opening structure 620 as viewed from the −X axis direction side.

In the present embodiment, the atmosphere opening structure 620 has a linking hole 622, a linking hole 623, a linking hole 624, a linking hole 625, a linking hole 626, a flow path forming surface 627, a film member 628, a linking chamber 631, a linking path 632, a linking chamber 633, a linking path 634, and a linking chamber 635 along with the atmosphere opening port 621.

The atmosphere opening port 621 of the atmosphere opening structure 620 is provided at the outer side (the +Z axis direction side) of the fourth wall surface 604. In the present embodiment, the atmosphere opening port 621 is provided at a position which protrudes from the fourth wall surface 604 in the +Z axis direction. In the present embodiment, an end portion 621*e* on the +Z axis direction side in the atmosphere opening port 621 is positioned at the +Z axis direction side of an end portion 612*e* on the +Z axis direction side in the ink filling port 612 as shown in FIG. 8B.

The linking chamber 631, the linking chamber 635, and the linking chamber 633 are provided at the inner side (the −Z axis direction side) of the fourth wall surface 604 in order from the +Y axis direction side to the −Y axis direction side. In the present embodiment, each of the linking chambers 631, 635, and 633 has a flow path cross sectional shape which is sufficiently larger than the atmosphere opening port 621, the linking holes 622, 623, 624, 625, and 626, and the linking paths 632 and 634.

The linking path 632 and the linking path 634 are provided at the outer side (the +Z axis direction side) of the fourth wall surface 604. In the present embodiment, the linking path 632 and the linking path 634 are flow paths directed toward the Y axis direction while alternately meandering in the +X axis direction and the −X axis direction. In the present embodiment, the linking path 632 and the linking path 634 are partitioned by a groove, which is formed in the flow path forming surface 627, and the film member 628 which is bonded with regard to the flow path forming surface 627 in a sealed state. In FIG. 8A, hatching is applied to a portion of the flow path forming surface 627 where the film member 628 is bonded. In the present embodiment, the film member 628 is formed of a synthetic resin (for example, a composite material of nylon and polypropylene).

The atmosphere opening port 621 is linked to the linking chamber 631. The linking hole 622 links between the linking chamber 631 and the linking path 632. The linking hole 623 links between the linking path 632 and the linking chamber 633. The linking hole 624 links between the linking chamber 633 and the linking path 634. The linking hole 625 links between the linking path 634 and the linking chamber 635. The linking hole 626 links between the linking chamber 635 and the ink storage section 610.

In FIG. 7 and FIG. 8B, the flow of air from the atmosphere opening port 621 to the ink storage section 610 is illustrated using arrows on a dashed line. The air which is taken in from the atmosphere opening port 621 flows into the linking chamber 631. The air in the linking chamber 631 flows into the linking chamber 633 through the linking hole 622, the linking path 632, and the linking hole 623. The air in the linking chamber 633 flows into the linking chamber 635 through the linking hole 624, the linking path 634, and the linking hole 625. The air in the linking chamber 635 flows into the ink storage section 610 through the linking hole 626. Due to this, it is possible to maintain the internal pressure in the ink storage section 610 at the same pressure as the atmosphere while preventing the leakage of ink from the atmosphere opening port 621.

Returning to the description of FIG. 7, the float valve 650 of the housing 510 forms a sealing structure which seals the inner section of the ink flow path 660 in the low ink remaining amount state where the remaining amount of the ink in the ink storage section 610 is a predetermined amount or less. FIG. 7 illustrates a state of the float valve 650 in a state which is not the low ink remaining amount state and where there is sufficient ink stored in the ink storage section 610. In FIG. 7, an ink surface FL which is the surface of the ink is positioned at the +Z axis direction side of the float valve 650.

Figure 9:
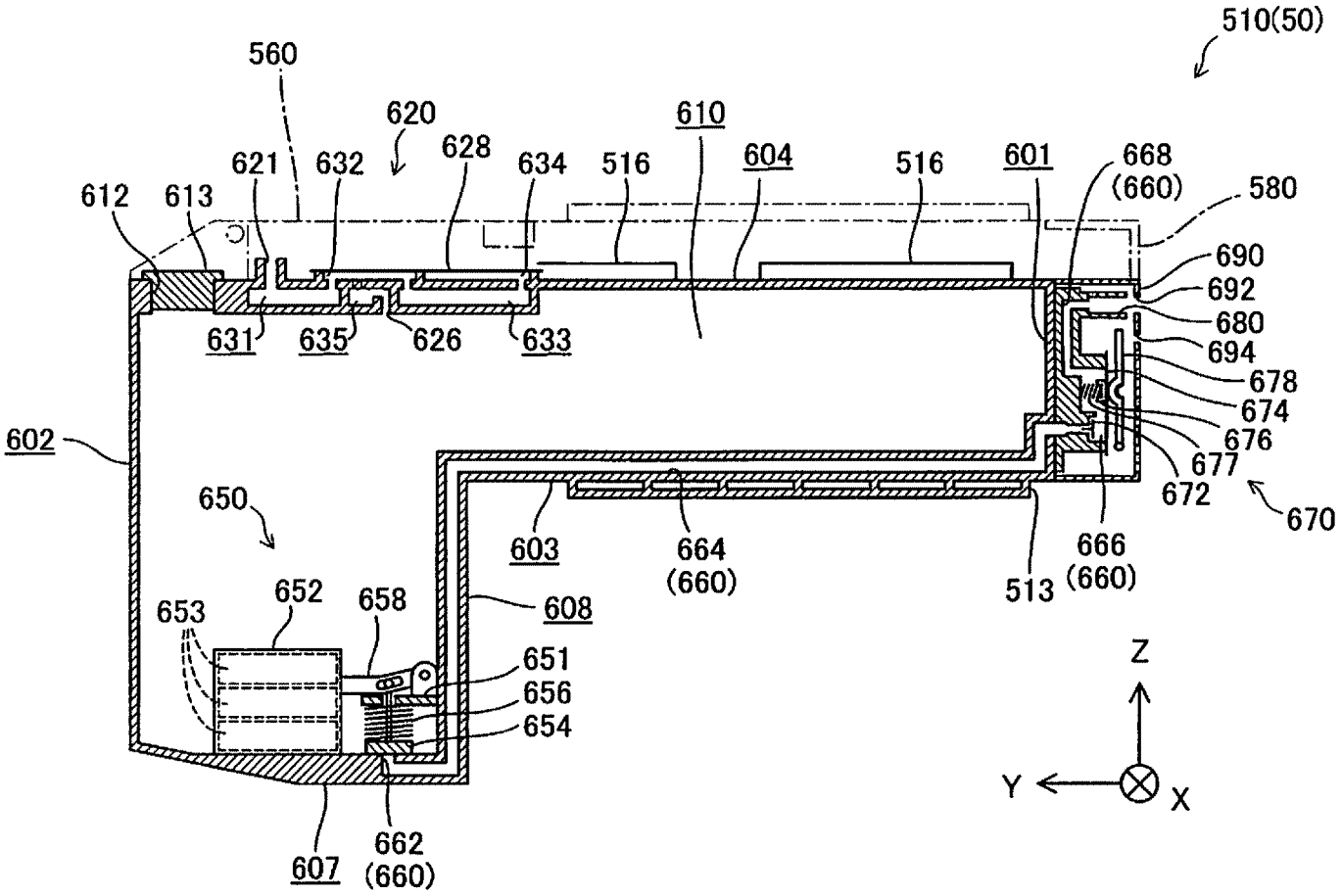
FIG. 9 is a cross sectional diagram illustrating an internal configuration of a cartridge in a low ink remaining amount state.

FIG. 9 is a cross sectional diagram illustrating an internal configuration of the cartridge 50 in the low ink remaining amount state. In the present embodiment, the remaining amount of the ink which is the low ink remaining amount state is set assuming a state, where the ink in the ink storage section 610 is substantially used up, that is, a state where the ink which flows through from the ink storage section 610 to the ink flow path 660 is used up, as the low ink remaining amount state. In other embodiments, the remaining amount of the ink which is the low ink remaining amount state may be set assuming a state, where a small amount of the ink in the ink storage section 610 remains, as the low ink remaining amount state.

As shown in FIG. 7 and FIG. 9, the float valve 650 is provided in the inner section of the ink storage section 610. The float valve 650 is provided with a support section 651, a buoyancy generating section 652, a valve section 654, an elastic member 656, and a joining member 658.

The support section 651 of the float valve 650 supports each of the sections of the float valve 650. In the present embodiment, the support section 651 is fixed to the eighth wall surface 608, but it is sufficient if support section 651 is fixed to at least one wall surface of the first to eighth wall surfaces 601 to 608 which partition the ink storage section 610.

The buoyancy generating section 652 of the float valve 650 is provided in the inner section of the ink storage section 610 and generates buoyancy with regard to the ink in the ink storage section 610. The buoyancy generating section 652 has a buoyant body 653 with a density which is lower than the ink.

In the present embodiment, the buoyant body 653 is an air chamber with air sealed in an inner section. In other embodiments, the buoyant body 653 may be a structure with another gas or a liquid with a density which is lower than the ink sealed inside, or may be plastic foam with a density which is lower than the ink.

In the present embodiment, the buoyancy generating section 652 has a plurality of the buoyant bodies 653. In the present embodiment, the number of the buoyant bodies 653 in the buoyancy generating section 652 is three but the number may be one, two, or four or more in other embodiments.

In the present embodiment, the plurality of buoyant bodies 653 in the buoyancy generating section 652 are lined up along the Z axis direction as shown in FIG. 7 and FIG. 9. In other embodiments, the plurality of buoyant bodies 653 in the buoyancy generating section 652 may be lined up along at least one of the X axis direction and the Y axis direction in addition to the Z axis direction. In other embodiments, the plurality of buoyant bodies 653 in the buoyancy generating section 652 may be lined up along at least one of the X axis direction and the Y axis direction instead of the Z axis direction.

The valve section 654 of the float valve 650 is configured so as to be able to open and close a communication port 662 according to the buoyancy due to the buoyancy generating section 652 and blocks off the communication port 662 in the low ink remaining amount state shown in FIG. 9. The communication port 662 which is opened and closed by the valve section 654 is an opening which links the ink storage section 610 to the ink supply port 680 and is provided in the inner side (the +Z axis direction side) of the seventh wall surface 607 in the present embodiment.

In the present embodiment, the valve section 654 is pressed in the −Z axis direction toward the communication port 662 by the elastic member 656 and is joined with the buoyancy generating section 652 to be able to receive force in the +Z axis direction based on the buoyancy due to the buoyancy generating section 652. In the present embodiment, the elastic member 656 is a coil spring. In the present embodiment, the valve section 654 is joined with the buoyancy generating section 652 via the joining member 658 which forms a lever but the valve section 654 may be joined directly to the buoyancy generating section 652 in other embodiments.

As shown in FIG. 7, in a state where the ink storage section 610 is sufficiently filled with ink, the buoyancy in the +Z axis direction due to the buoyancy generating section 652 is larger than the pressing force in the −Z axis direction due to the elastic member 656. Due to this, the valve section 654 is separated from the communication port 662 in the +Z axis direction and the communication port 662 is opened with regard to the ink storage section 610.

In the low ink remaining amount state shown in FIG. 9, the buoyancy in the +Z axis direction due to the buoyancy generating section 652 is less than the pressing force in the −Z axis direction due to the elastic member 656. Due to this, the valve section 654 is tightly attached to the communication port 662 and blocks off the communication port 662 with regard to the ink storage section 610.

Returning to the description in FIG. 7, the ink flow path 660 of the housing 510 links between the ink storage section 610 and the ink supply port 680 and is configured such that it is possible for ink from the ink storage section 610 to flow into the ink supply port 680. In FIG. 7, the flow of ink from the ink storage section 610 via the ink flow path 660 to the ink supply port 680 is illustrated using arrows on a dashed line. The ink flow path 660 has a flow path 664, a flow path 666, and a flow path 668 along with the communication port 662 described above.

The communication port 662 of the ink flow path 660 is provided in the wall surface which partitions the −Z axis direction side in the ink storage section 610 and is provided in the inner side (the +Z axis direction side) of the seventh wall surface 607 in the present embodiment as described above. In the present embodiment, the communication port 662 has a flow path cross sectional shape which is sufficiently smaller than the ink storage section 610.

The flow path 664 of the ink flow path 660 links between the communication port 662 and the flow path 666. In the present embodiment, the flow path 664 proceeds from the communication port 662 with the seventh wall surface 607 in the −Y axis direction and proceeds with the eighth wall surface 608 in the +Z axis direction, and then, proceeds with the third wall surface 603 in the −Y axis direction and reaches the flow path 666 via the first wall surface 601. In the present embodiment, the flow path 664 has a flow path cross sectional shape which is sufficiently smaller than the ink storage section 610.

The flow path 666 of the ink flow path 660 links between the flow path 664 and the flow path 668 and the displacement section 670 is configured in the inner section of the flow path 666. In the present embodiment, the flow path 666 is provided at the outer side (the −Y axis direction side) of the first wall surface 601. In the present embodiment, the flow path 666 has a flow path cross section shape which is sufficiently smaller than the ink storage section 610 and larger than the flow path 664 and the flow path 668.

The flow path 668 of the ink flow path 660 links between the flow path 666 and the ink supply port 680. In the present embodiment, the flow path 668 is provided at the outer side (the −Y axis direction side) of the first wall surface 601. In the present embodiment, the flow path 668 has a flow path cross section shape which is sufficiently smaller than the ink storage section 610.

The displacement section 670 of the housing 510 configures a portion of the flow path 666 in the ink flow path 660 and is displaced according to the internal pressure in the ink flow path 660 so as to be able to be detected by the printer 20. The displacement section 670 has a check valve 672, a film member 674, a plate member 676, an elastic member 677, and a lever member 678. The check valve 672 of the displacement section 670 prevents the reverse flow of ink from the flow path 666 to the flow path 664.

The film member 674 of the displacement section 670 is a thin film which has ink impermeability, airtightness, and flexibility, and partitions a portion of the flow path 666 in the ink flow path 660. In the present embodiment, the film member 674 partitions the −Y axis direction side of the flow path 666 along the ZX plane which is parallel to the Z axis and the X axis. In the present embodiment, the film member 674 is configured so as to be able to be displaced along the Y axis direction according to the internal pressure in the flow path 666. In the present embodiment, the film member 674 is formed of a synthetic resin (for example, a composite material of nylon and polypropylene).

The plate member 676 of the displacement section 670 is provided in an inner section of the flow path 666 in the ink flow path 660, is pressed toward the film member 674 by the elastic member 677, and comes into contact with the inner side (the +Y axis direction side) of the film member 674. In the present embodiment, the plate member 676 is pressed in the −Y axis direction toward the film member 674 by the elastic member 677. In the present embodiment, the plate member 676 is formed in a disk shape. In the present embodiment, the elastic member 677 is a coil spring.

The lever member 678 of the displacement section 670 increases the amount of displacement of the film member 674 and transmits the displacement to the printer 20. In the present embodiment, the lever member 678 is configured to come into contact with the outer side (the −Y axis direction side) of the film member 674 to correspond to the position where the plate member 676 comes into contact with the film member 674 and to be able to swing along the Y axis direction according to the displacement of the film member 674.

Figure 10A:
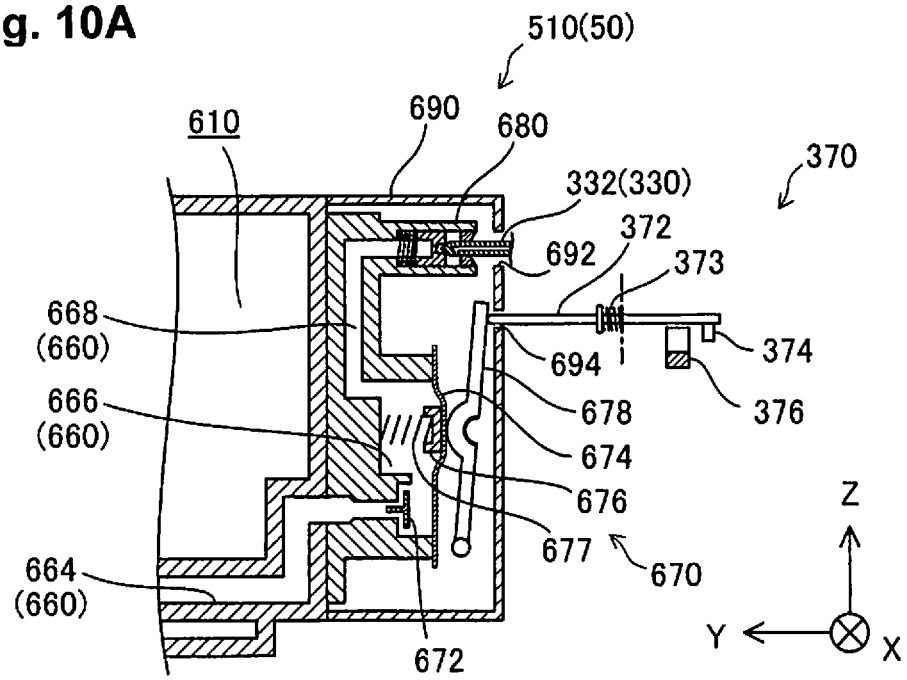
FIGS. 10A and 10B are explanatory diagrams illustrating a detailed configuration of the −Y axis direction side of a cartridge which is mounted into a holder.
Figure 10B:
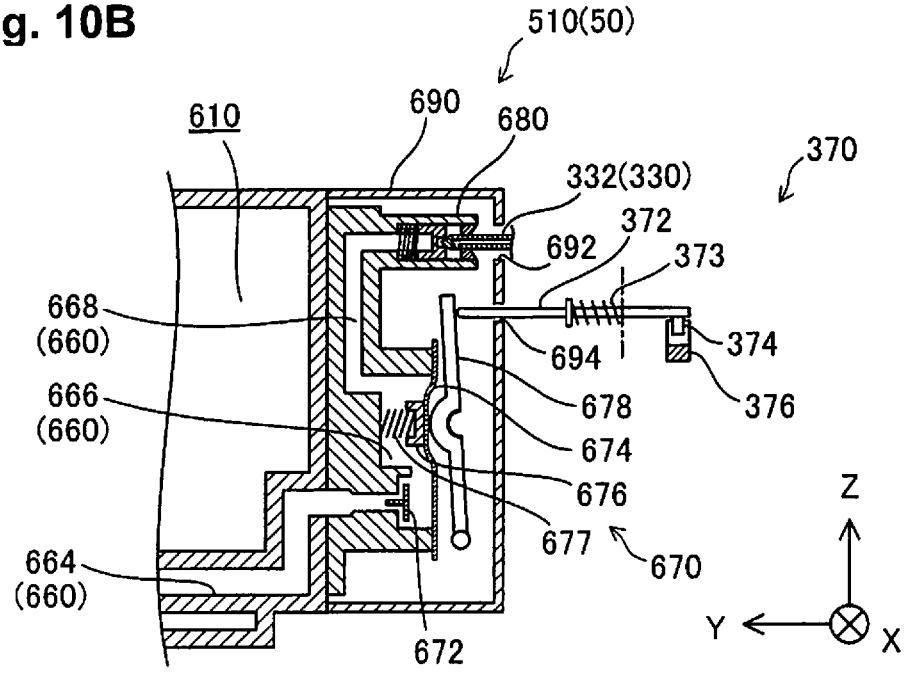

FIGS. 10A and 10B are explanatory diagrams illustrating a detailed configuration of the −Y axis direction side of the cartridge 50 which is mounted into the holder 30. FIG. 10A which is shown in the upper part of FIG. 10 illustrates a state where the displacement section 670 is displaced to the +Y axis direction side. FIG. 10B which is shown in the lower part of FIG. 10 illustrates a state where the displacement section 670 is displaced to the −Y axis direction side. In FIG. 10, illustration of the slider 560 and the circuit member 580 is omitted.

In a state where the cartridge 50 is mounted into the holder 30, an ink supply pipe 332 of an ink supply mechanism 330 in the holder 30 is inserted into the ink supply port 680 of the cartridge 50. Due to this, the ink supply port 680 is linked with the ink supply pipe 332 and it is possible for ink to flow from the ink supply port 680 to the ink supply pipe 332.

In a state where the cartridge 50 is mounted into the holder 30, a rod member 372 of a displacement detection mechanism 370 in the holder 30 comes into contact with the lever member 678 of the displacement section 670 in the cartridge 50. In the present embodiment, the rod member 372 in the holder 30 is configured to be pressed by an elastic member 373 in the +Y axis direction toward the lever member 678 in the cartridge 50 and so as to be able to move along the Y axis direction according to the swinging of the lever member 678.

In the present embodiment, a convex section 374 is formed in the rod member 372 and a sensor 376 is fixed at a position of the convex section 374 of the rod member 372 in the state shown in FIG. 10B. The printer 20 is configured so as to be able to detect the state shown in FIG. 10 (B) by using the sensor 376. In the present embodiment, the sensor 376 uses a detection element which optically detects the position of the rod member 372 but detection elements which perform detection mechanically, electromagnetically, thermally, acoustically, or chemically may be used in other embodiments.

As shown in FIG. 10A, in a situation where the ink is not sucked from the holder 30 side, the film member 674 of the displacement section 670 is pushed out to the outer side of the flow path 666 by the elastic member 677 of the displacement section 670 and protrudes in the −Y axis direction so as to increase the capacity of the flow path 666 in the ink flow path 660. In accordance with the increase in the capacity of the flow path 666, ink flows into the flow path 666 from the flow path 664 of the ink flow path 660.

When the ink is sucked from the holder 30 side, ink is supplied from the ink flow path 660 through the ink supply port 680 to the ink supply pipe 332 and the filling amount of the ink from the flow path 664 to the flow path 666 does not keep pace with regard to the outflow amount of the ink from the flow path 666 to the flow path 668, and the internal pressure in the flow path 666 becomes a lower pressure than atmospheric pressure. Due to this, the film member 674 of the displacement section 670 is drawn to the inner side of the flow path 666 and depressed in the +Y axis direction as shown in FIG. 10B.

In a case where ink is stored in the ink storage section 610 as shown in FIG. 7, the negative pressure which is generated in the flow path 666 due to the suction of the ink from the holder 30 side is reduced gradually by the filling of ink into the ink storage section 610 through the flow path 664 to the flow path 666. In accordance with the elimination of the negative pressure in the flow path 666, the film member 674 of the displacement section 670 reaches a state of protruding in the −Y axis direction as shown in FIG. 10A.

On the other hand, in a case where the ink storage section 610 reaches the low ink remaining amount state, as shown in FIGS. 8A and 8B, since the communication port 662 of the ink flow path 660 is blocked off by the float valve 650, the negative pressure which is generated in the flow path 666 is maintained until ink is refilled into the ink storage section 610. Due to this, in a case where the ink storage section 610 reaches the low ink remaining amount state, the film member 674 of the displacement section 670 is maintained in a state of being depressed in the +Y axis direction as shown in FIG. 10B.

In the present embodiment, the printer 20 detects the situation shown in FIG. 10B using the sensor 376 and determines that the ink storage section 610 is in the low ink remaining amount state in a case where the situation which is shown in FIG. 10B continues for a predetermined length of time. In the present embodiment, the printer 20 provides notification to the effect that it is necessary to refill the ink with regard to the ink storage section 610 when it is determined that the ink storage section 610 is in the low ink remaining amount state.

When the ink is refilled into the ink storage section 610 as described using FIG. 3 after the ink storage section 610 reaches the low ink remaining amount state, the negative pressure which is generated in the flow path 666 is gradually released due to the blocking off of the communication port 662 by the float valve 650 being released and ink in the ink storage section 610 flowing into the flow path 666 through the flow path 664. In accordance with the elimination of the negative pressure in the flow path 666, the film member 674 of the displacement section 670 returns to a state of protruding in the −Y axis direction as shown in FIG. 10A.

The ink supply port 680 of the housing 510 is linked with the ink flow path 660 and supplies ink from the ink flow path 660 to the printer 20. In the present embodiment, the ink supply port 680 is provided at the outer side (the −Y axis direction side) of the first wall surface 601. In the present embodiment, the ink supply port 680 is provided to the +Z axis direction side of the displacement section 670. In the present embodiment, the ink supply port 680 is configured so as to be able to receive the insertion of the ink supply pipe 332 of the ink supply mechanism 330 in the holder 30 as shown in FIG. 10. In the present embodiment, the ink supply port 680 is configured so as to be sealed in a state where the ink supply pipe 332 is not inserted.

The cover 690 of the housing 510 protects the displacement section 670 and the ink supply port 680 by covering the displacement section 670 and the ink supply port 680 which are provided at the outer side (the −Y axis direction side) of the first wall surface 601. A through hole 692 and a through hole 694 are provided in the cover 690. The through hole 692 in the cover 690 is provided at a position which corresponds to the ink supply port 680 and is configured so as to be able to receive the insertion of the ink supply pipe 332 from the holder 30 with regard to the ink supply port 680. The through hole 694 in the cover 690 is provided at a position which corresponds to the lever member 678 of the displacement section 670 and is configured so as to be able to receive the insertion of the rod member 372 from the holder 30 with regard to the lever member 678.

Figure 11:
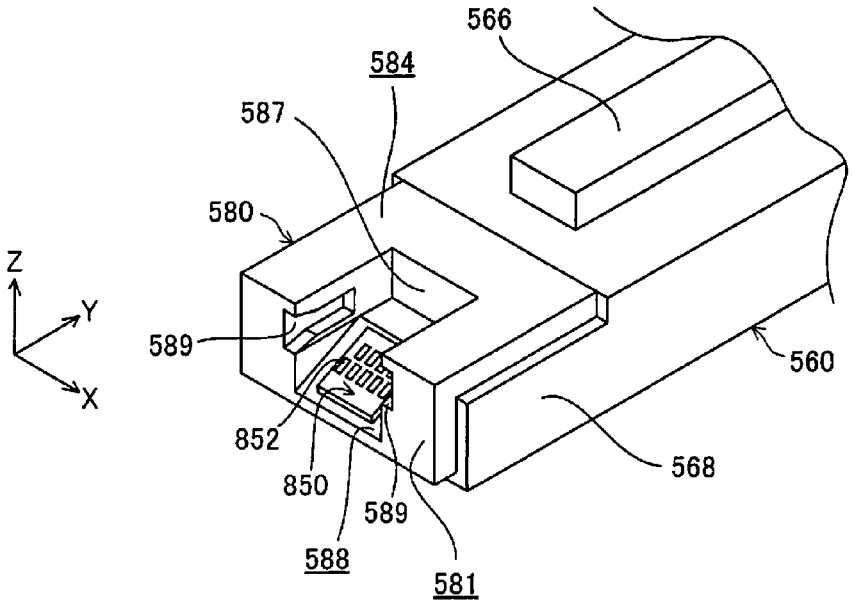
FIG. 11 is a perspective diagram illustrating a circuit member which is mounted into a slider.
Figure 12:
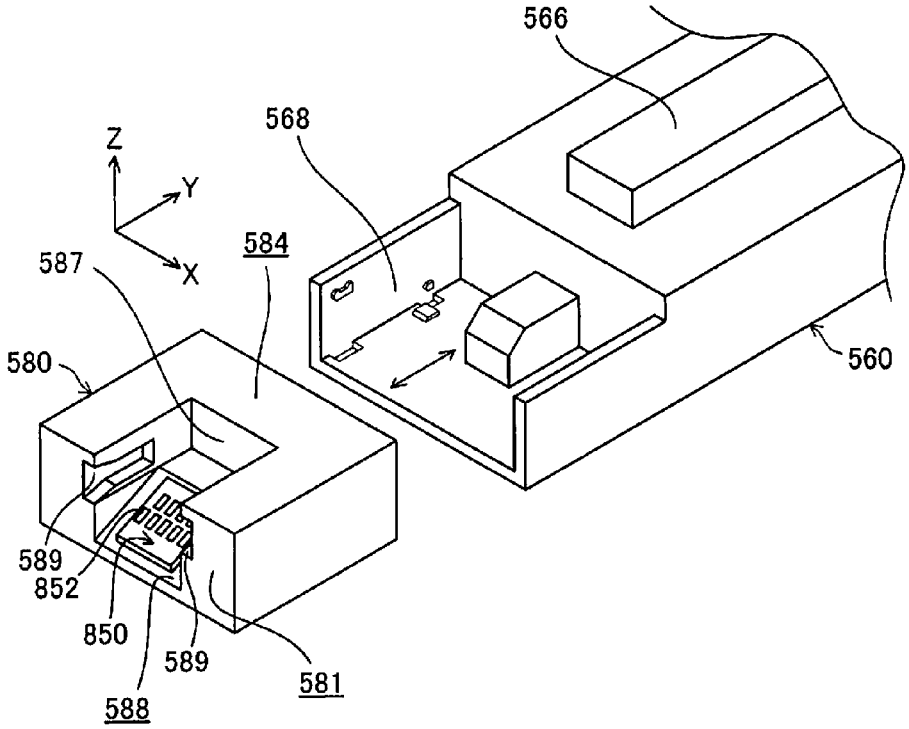
FIG. 12 is an assembled perspective diagram illustrating a state where a circuit member is detached from a slider.

FIG. 11 is a perspective diagram illustrating the circuit member 580 which is mounted into the slider 560. FIG. 12 is an assembled perspective diagram illustrating a state where the circuit member 580 is detached from the slider 560. As shown in FIG. 11 and FIG. 12, a fastening section 568 is formed at the −Y axis direction side of the slider 560. The fastening section 568 is configured so as to be able to fasten the circuit member 580.

In the present embodiment, when attaching the circuit member 580 to the slider 560, it is possible for the user of the printing system 10 to mount the circuit member 580 on the slider 560 by fastening the circuit member 580 with regard to the fastening section 568 while sliding the circuit member 580 in the +Y axis direction with regard to the fastening section 568 of the slider 560. In the present embodiment, when the circuit member 580 is detached from the slider 560, it is possible for the user to detach the circuit member 580 from the slider 560 by releasing the fastening of the circuit member 580 using the fastening section 568 by sliding the circuit member 580 in the −Y axis direction with regard to the fastening section 568 of the slider 560.

The circuit member 580 of the cartridge 50 has a circuit board 850 where a connection terminal 852 is formed and is configured so as to be able to be attached and detached with regard to the slider 560. In the present embodiment, the circuit member 580 forms an approximately rectangular shape and has an outer surface 581, an outer surface 584, a concave section 587, an inclined surface 588, and position aligning sections 589.

The outer surface 581 of the circuit member 580 is a surface in the −Y axis direction along the ZX plane which is parallel to the Z axis and the X axis. The outer surface 584 of the circuit member 580 is a surface in the +Z axis direction along the XY plane which is parallel to the X axis and the Y axis.

The concave section 587 of the circuit member 580 is a location where a location on the −Y axis direction side in the center of the X axis direction in the outer surface 584 to the outer surface 581 is depressed in the Z axis direction. The inclined surface 588 of the circuit member 580 is a surface which is provided in the concave section 587 and which is inclined in the −Y axis direction and the +Z axis direction. The circuit board 850 is attached to the inclined surface 588.

The position aligning sections 589 of the circuit member 580 positionally align the connection terminal 852 of the circuit board 850 with regard to the holder 30. In the present embodiment, the position aligning sections 589 are concave ridge sections along the Y axis direction and are each provided on surfaces which face each other along the YZ plane which is parallel to the Y axis and the Z axis in the concave section 587.

Figure 13:
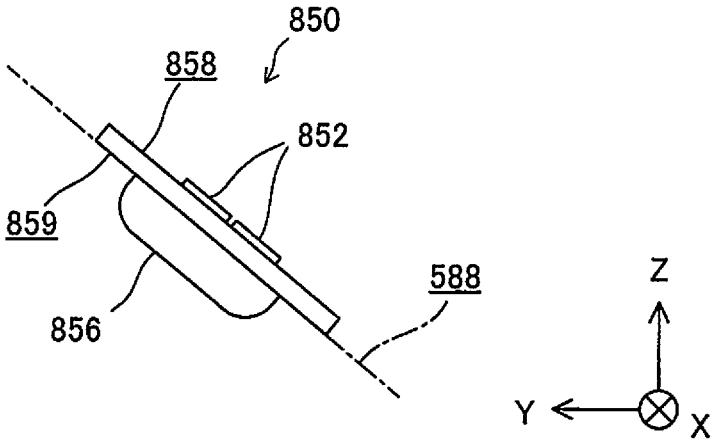
FIG. 13 is an explanatory diagram illustrating a circuit board which is attached to a circuit member.

FIG. 13 is an explanatory diagram illustrating the circuit board 850 which is attached to the circuit member 580. The circuit board 850 has a circuit element 856, a terminal surface 858, and a mounting surface 859 in addition to the connection terminal 852. The connection terminal 852 of the circuit board 850 is configured so as to be able to be electrically connected due to contact with regard to the holder 30 side. The circuit element 856 of the circuit board 850 is a storage apparatus which is configured so as to be able to store information which relates to ink.

The terminal surface 858 of the circuit board 850 is a surface where the connection terminal 852 is formed and which is at the back of the mounting surface 859. In a state where the circuit board 850 is attached to the inclined surface 588 of the circuit member 580, the terminal surface 858 is in a state of facing the −Y axis direction and the +Z axis direction.

The mounting surface 859 of the circuit board 850 is a surface where the circuit element 856 is formed and which is at the back of the terminal surface 858. In a state where the circuit board 850 is attached to the inclined surface 588 of the circuit member 580, the mounting surface 859 is in a state of facing the +Y axis direction and the −Z axis direction.

A-3. Detailed Configuration of Holder

Figure 14:
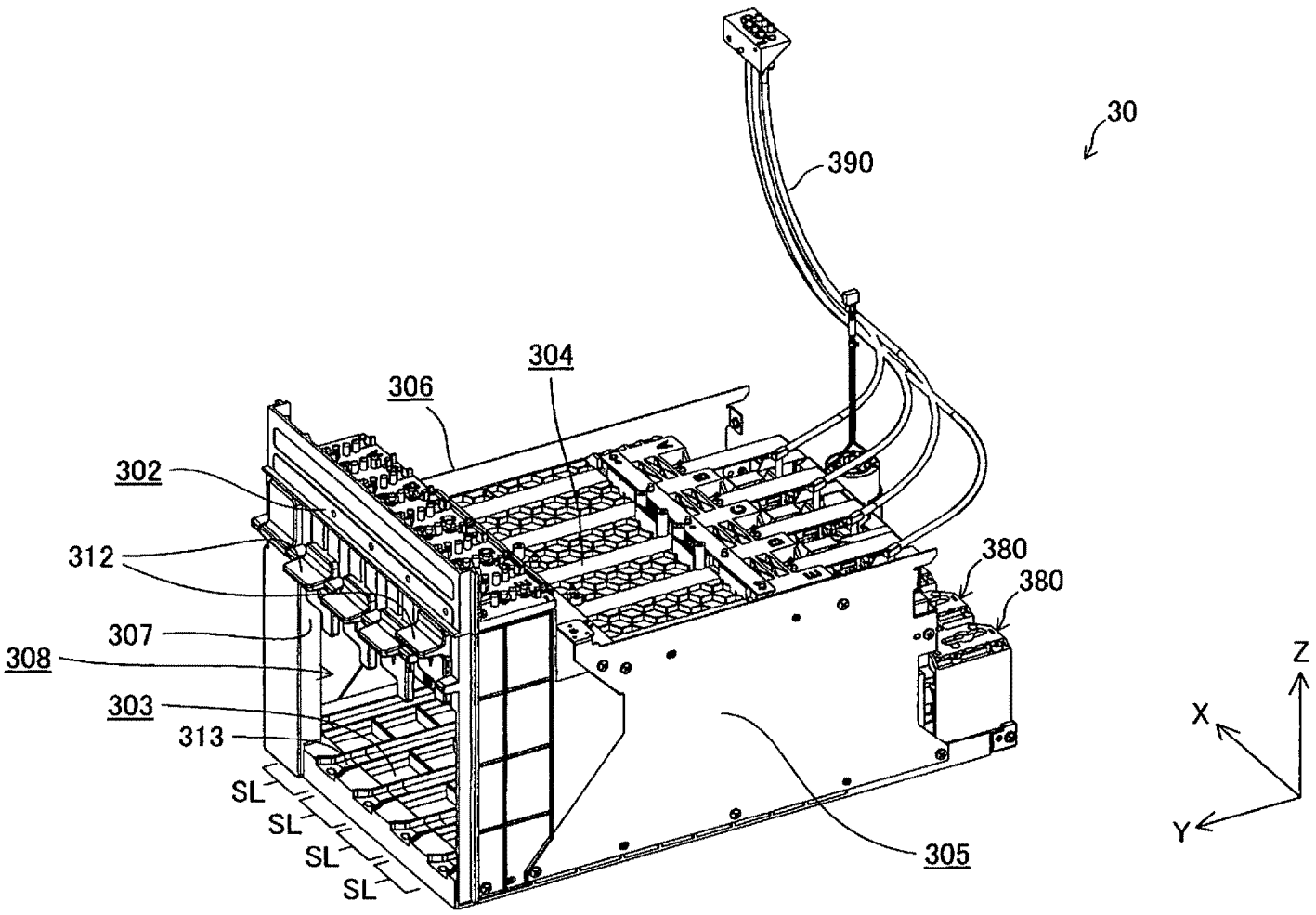
FIG. 14 is a perspective diagram illustrating a configuration of a holder.
Figure 15:
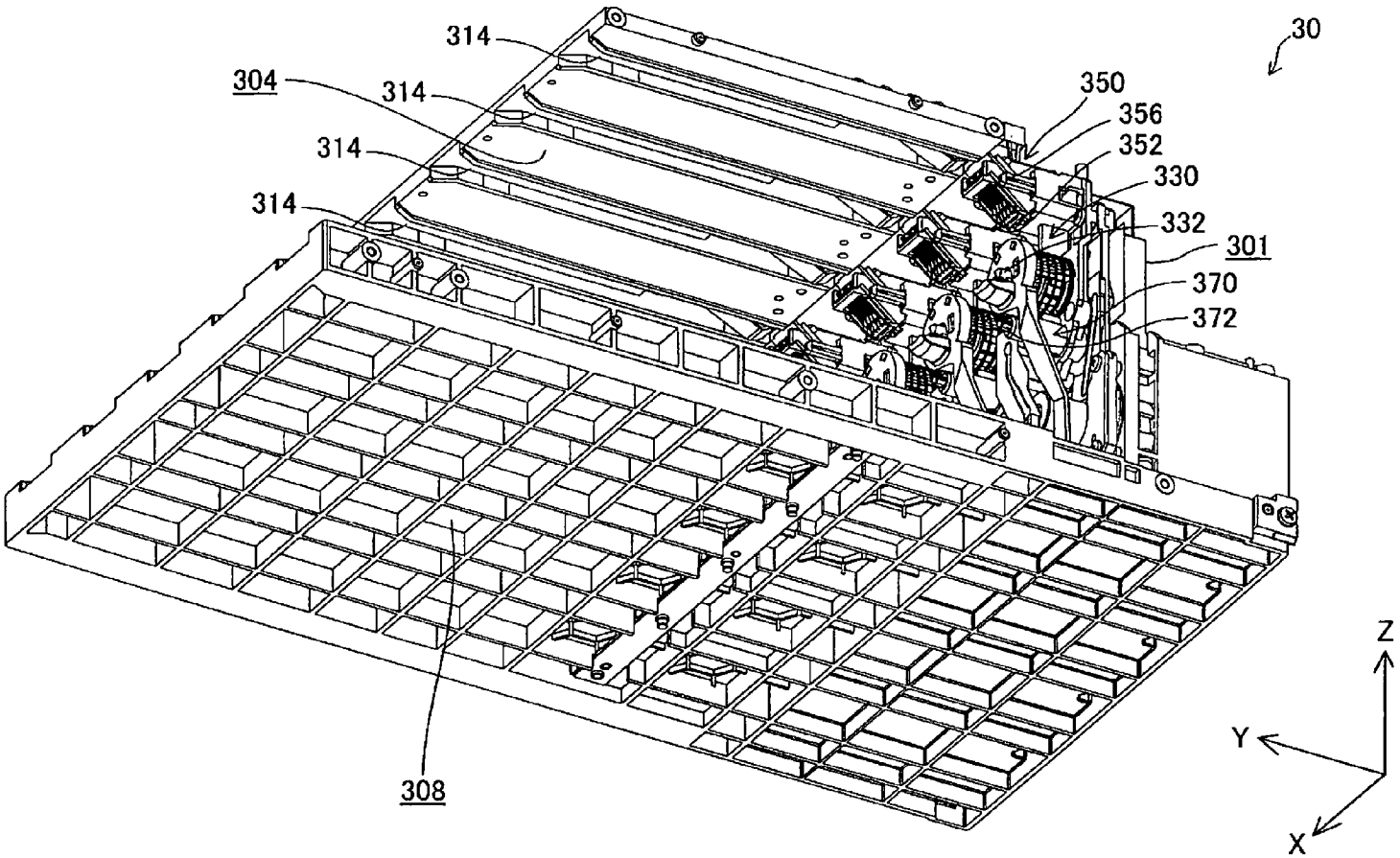
FIG. 15 is a perspective diagram illustrating a configuration of a holder.
Figure 16:
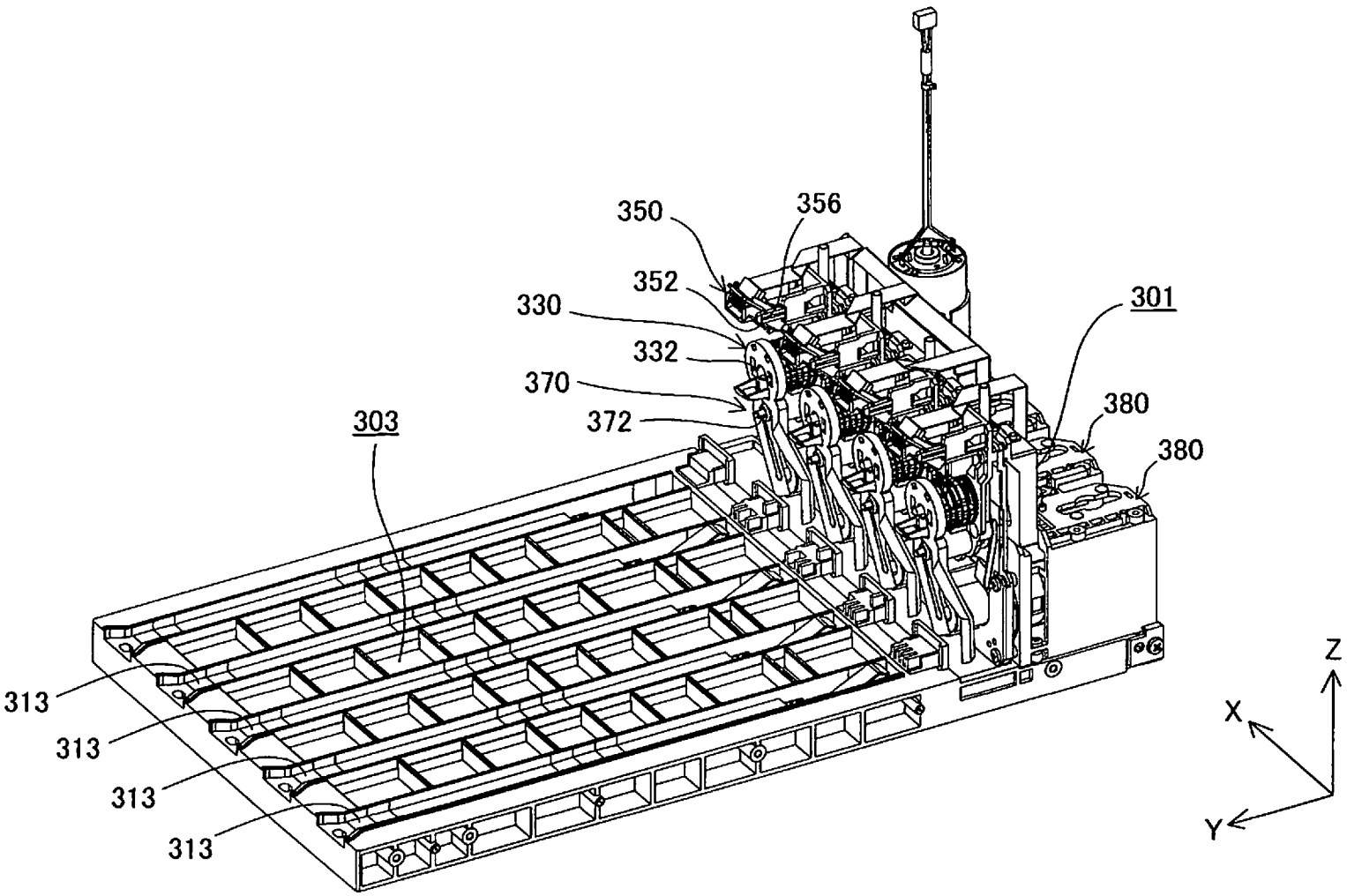
FIG. 16 is a perspective diagram illustrating a configuration of a holder.

FIG. 14, FIG. 15, and FIG. 16 are perspective diagrams illustrating the configuration of the holder 30. FIG. 15 and FIG. 16 illustrate the holder 30 by omitting a portion of the holder 30.

The holder 30 of the printer 20 has five wall sections 301, 303, 304, 305, and 306 as wall surfaces which partition a cartridge mounting space 308 where the cartridge 50 is mounted. In the present embodiment, the five wall sections 301, 303, 304, 305, and 306 are formed by plate members.

The wall section 301 of the holder 30 is erected along the ZX plane on the −Y axis direction side of the wall section 303 and configures the rear surface of the holder 30 in the state of being used by the printing system 10. The wall section 303 of the holder 30 is erected along the XY plane on the −Z axis direction side of the holder 30 and configures the bottom surface of the holder 30 in the state of being used by the printing system 10. The wall section 304 of the holder 30 is erected at a position which faces the wall section 303 on the +Z axis direction side of the holder 30 and configures the upper surface of the holder 30 in the state of being used by the printing system 10. The wall section 305 of the holder 30 is erected along the YZ plane on the −X axis direction side of the wall section 303 and configures the right side surface of the holder 30 in the state of being used by the printing system 10. The wall section 306 of the holder 30 is erected along the YZ plane in the +X axis direction side of the wall section 303 and configures the left side surface of the holder 30 in the state of being used by the printing system 10.

As shown in FIG. 14, a plurality of the slots SL which are configured so as to be able to be mounted with the cartridges 50 are formed in the cartridge mounting space 308 of the holder 30. In the present embodiment, the plurality of slots SL are lined up along the X axis direction. As shown in FIG. 14 to FIG. 16, the holder 30 is provided with a concave ridge section 313, a concave ridge section 314, the ink supply mechanism 330, a terminal platform 350, the displacement detection mechanism 370, and a suction pump 380 in each slot SL.

The concave ridge section 313 of the holder 30 is at a location which is provided in the inner side (the +Z axis direction side) of the wall section 303 and is depressed in the −Z axis direction continuous along the Y axis. The concave ridge section 313 guides the attachment and detachment of the cartridge 50 with regard to the holder 30 by engaging with the convex ridge section 513 of the cartridge 50.

The concave ridge section 314 of the holder 30 is at a location which is provided in the inner side (the −Z axis direction side) of the wall section 304 and depressed in the +Z axis direction continuous along the Y axis. The concave ridge section 314 guides the attachment and detachment of the cartridge 50 with regard to the holder 30 by engaging with the convex ridge section 566 of the cartridge 50.

The ink supply mechanism 330 of the holder 30 is provided at the inner side (the +Y axis direction side) of the wall section 301. The ink supply mechanism 330 has the ink supply pipe 332, receives the supply of ink from the ink supply port 680 of the cartridge 50, and supplies the ink to the head 260 of the carriage 250 via the flexible tube 390. In the present embodiment, the ink supply pipe 332 of the ink supply mechanism 330 is configured so as to be sealed in a state of not being inserted in the ink supply port 680 of the cartridge 50.

The terminal platform 350 of the holder 30 is provided at a position which is adjacent to the wall section 301 and the wall section 304. The terminal platform 350 has a connection terminal 352 which is configured so as to be able to electrically connect to the connection terminal 852 of the cartridge 50. In the present embodiment, the connection terminal 352 is electrically connected to the control section 220. In the present embodiment, the terminal platform 350 has an engaging section 356 which is configured so as to be able to engage with regard to the position aligning section 589 of the circuit member 580 in the cartridge 50.

The displacement detection mechanism 370 of the holder 30 is provided at the inner side (the +Y axis direction side) of the wall section 301. The displacement detection mechanism 370 has the rod member 372 and is configured so as to be able to detect the displacement of the lever member 678 of the displacement section 670 in the cartridge 50. The suction pump 380 of the holder 30 sucks ink from the cartridge 50 through the ink supply pipe 332 of the ink supply mechanism 330.

A-4. Effects

According to the first embodiment described above, since the inner section of the ink flow path 660 is sealed when the ink storage section 610 reaches the low ink remaining amount state, it is possible to detect the low ink remaining amount state in the ink storage section 610, which is configured such that the ink is able to flow in via the ink filling port 612, at the printer 20 side based on the displacement of the displacement section 670 according to the internal pressure in the ink flow path 660. Due to this, it is possible to improve the degree of precision for detecting the low ink remaining amount state of the ink while suppressing the complexity of the configuration in the cartridge 50.

In addition, when the ink storage section 610 reaches the low ink remaining amount state, since the communication port 662 of the ink flow path 660 is blocked off by the valve section 654 of the float valve 650 and it is possible to seal the ink flow path 660, it is possible to perform detection of the low ink remaining amount state based on the displacement of the displacement section 670 according to the internal pressure in the ink flow path 660 even when the ink storage section 610 is opened with regard to the atmosphere.

In addition, since the buoyancy generating section 652 of the float valve 650 has the plurality of buoyant bodies 653, even in a case where a portion of the plurality of buoyant bodies 653 are damaged, it is possible to operate the valve section 654 using the other buoyant bodies 653. Due to this, it is possible to suppress failures to detect the low ink remaining amount state.

In addition, since the plurality of buoyant bodies 653 are lined up along the Z axis direction, the posture change of the buoyancy generating section 652 is reduced in a case where a portion of the plurality of buoyant bodies 653 are damaged and it is possible to suppress operation failure of the valve section 654 compared to a case where the plurality of buoyant bodies 653 are lined up along the horizontal direction (the Y axis direction). Due to this, it is possible to further suppress failures to detect the low ink remaining amount state.

In addition, since the end portion 621*e* on the +Z axis direction side of the atmosphere opening port 621 is positioned at the +Z axis direction side of the end portion 612*e* on the +Z axis direction side in the ink filling port 612, it is possible for the ink to overflow from the ink filling port 612 prior to the atmosphere opening port 621 in a case where there is an excessive filling of ink into the ink storage section 610. Due to this, it is possible to prevent the blocking off between the ink storage section 610 and the atmosphere opening port 621 due to the ink flowing in from the ink storage section 610 to the atmosphere opening port 621.

In addition, since the communication port 662 of the ink flow path 660 is provided in the seventh wall surface 607 which partitions the −Z axis direction side of the ink storage section 610, it is possible to supply the ink, which is stored in the −Z axis direction side of the ink storage section 610 where the mixing in of foreign material such as dust and air is comparatively small, to the printer 20.

In addition, since the circuit member 580 is positioned at the −Y axis direction side of the ink filling port 612 in a state where the slider 560, where the circuit member 580 is mounted, is mounted into the housing 510, it is possible to attach and detach the circuit member 580 in a state where the housing 510 where ink storage section 610 is provided is mounted into the holder 30 of the printer 20 while preventing fouling of the circuit board 850 by ink which flows in from the ink filling port 612.

In addition, since the slider 560 covers the atmosphere opening port 621 in a state of being mounted into the housing 510, it is possible to prevent the mixing in of foreign material from the atmosphere opening port 621 to the ink storage section 610 or the blocking off of the atmosphere opening port 621 due to foreign material.

In addition, it is possible to prevent contact defects between the connection terminal 852 in the cartridge 50 side and the connection terminal 352 in the holder 30 side since the circuit member 580 has the position aligning section 589 which positionally aligns the connection terminal 852 with regard to the connection terminal 352 in the holder 30 side.

B. Second Embodiment

Figure 17:
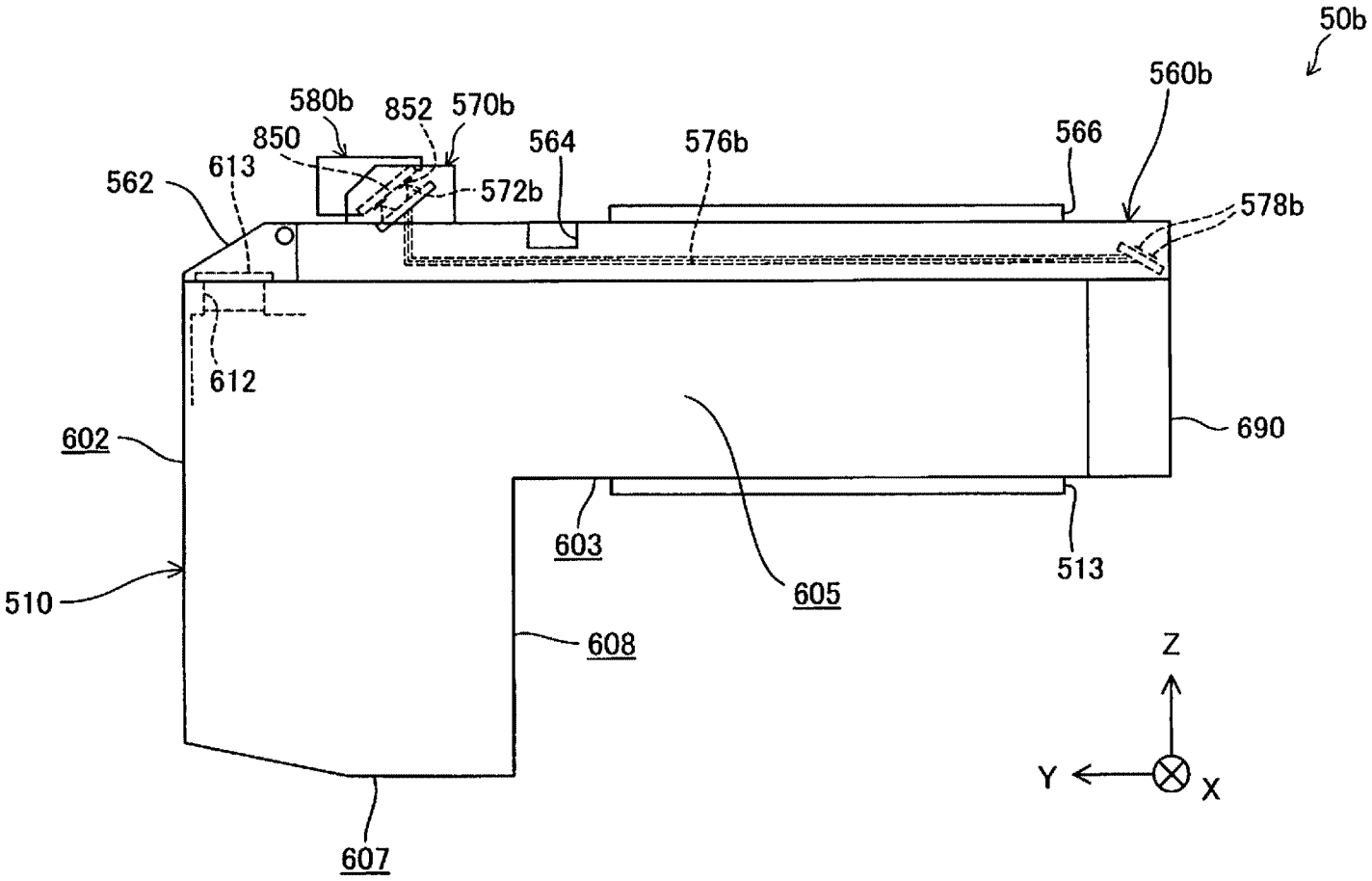
FIG. 17 is a right side surface diagram illustrating a configuration of a cartridge in a second embodiment.

FIG. 17 is a right side surface diagram illustrating a configuration of a cartridge 50*b* in a second embodiment. The second embodiment is the same as the first embodiment except for the point that the cartridge 50*b* is used instead of all or a portion of the plurality of cartridges 50. In the second embodiment, it is possible to apply the same configuration as the first embodiment including modified examples. In the description of the second embodiment, the same reference numerals are used for the same configuration as the first embodiment and description thereof will be omitted.

The cartridge 50*b* of the second embodiment is the same as the cartridge 50 of the first embodiment except for the point that a sub-housing 560*b* is provided instead of the slider 560 of the first embodiment and the point that a circuit member 580*b* is provided instead of the circuit member 580 of the first embodiment. In the present embodiment, the circuit member 580*b* of the cartridge 50*b* has the circuit board 850 in the same manner as the circuit member 580 of the first embodiment.

The sub-housing 560*b* of the cartridge 50*b* is configured to be integral with the housing 510. In the present embodiment, the sub-housing 560*b* is configured so as to be able to be attached and detached with regard to the housing 510 by sliding in the same manner as the slider 560 of the first embodiment, but the sub-housing 560*b* may be fixed with regard to the housing 510 in other embodiments. The sub-housing 560*b* of the cartridge 50*b* has a terminal platform 570*b*, a housing side terminal 572*b*, relay wiring 576*b*, and a relay terminal 578*b*.

The terminal platform 570*b* of the sub-housing 560*b* is configured so as to be able to be attached and detached to and from the circuit member 580*b*. The terminal platform 570*b* is provided at a position which is the outer side of the holder 30 in a state where the cartridge 50*b* is mounted into the holder 30 and is provided between the lid section 562 and the concave section 564 in the present embodiment.

The housing side terminal 572*b* of the sub-housing 560*b* is provided on the terminal platform 570*b* and is electrically connected due to contact with regard to the connection terminal 852 of the circuit board 850 in the circuit member 580*b* which is mounted into the terminal platform 570*b*. In the present embodiment, the housing side terminal 572*b* is positioned at the +Z axis direction side of the ink filling port 612. Due to this, it is possible to prevent fouling of the housing side terminal 572*b* by ink which flows in from the ink filling port 612.

The relay wiring 576*b* of the sub-housing 560*b* is provided in the inner section of the sub-housing 560*b* and electrically connects the terminal platform 570*b* and the relay terminal 578*b*. In the present embodiment, the relay wiring 576*b* is positioned on the +Z axis direction side of the ink filling port 612. Due to this, it is possible to prevent fouling of the relay wiring 576*b* by ink which flows in from the ink filling port 612.

The relay terminal 578*b* of the sub-housing 560*b* is provided on the −Y axis direction side of the sub-housing 560*b* and is configured so as to be able to be electrically connected due to contact with regard to the connection terminal 352 of the holder 30 in the printer 20. In the present embodiment, the relay terminal 578*b* is positioned at the +Z axis direction side of the ink filling port 612. Due to this, it is possible to prevent fouling of the relay terminal 578*b* by ink which flows in from the ink filling port 612.

According to the second embodiment described above, it is possible to improve the degree of precision for detecting the low ink remaining amount state of the ink while suppressing the complexity of the configuration in the cartridge 50 in the same manner as the first embodiment. In addition, in addition to these, it is possible to achieve the same effect as the first embodiment, and in cases where modified examples are applied, it is possible to achieve the same effects as in cases where modified examples are applied to the first embodiment.

In addition, since the housing side terminal 572*b* is positioned at the +Z axis direction side of the ink filling port 612, it is possible to attach and detach the circuit member 580*b* in a state where the cartridge 50*b* is mounted into the holder 30 of the printer 20 while preventing fouling of the circuit board 850 by ink which flows in from the ink filling port 612. In addition, it is possible to attach and detach the circuit member 580*b* without sliding the circuit member 580 as in the first embodiment.

As a modified example of the second embodiment, a terminal platform where a circuit member is attached and detached may be provided on the second wall surface 602 in the housing 510. According to this modified example, it is possible to attach and detach the circuit member in a state where the cartridge 50*b* is mounted into the holder 30 of the printer 20. In addition, it is possible to attach and detach the circuit member without sliding the circuit member 580 as in the first embodiment.

C. Third Embodiment

Figure 18:
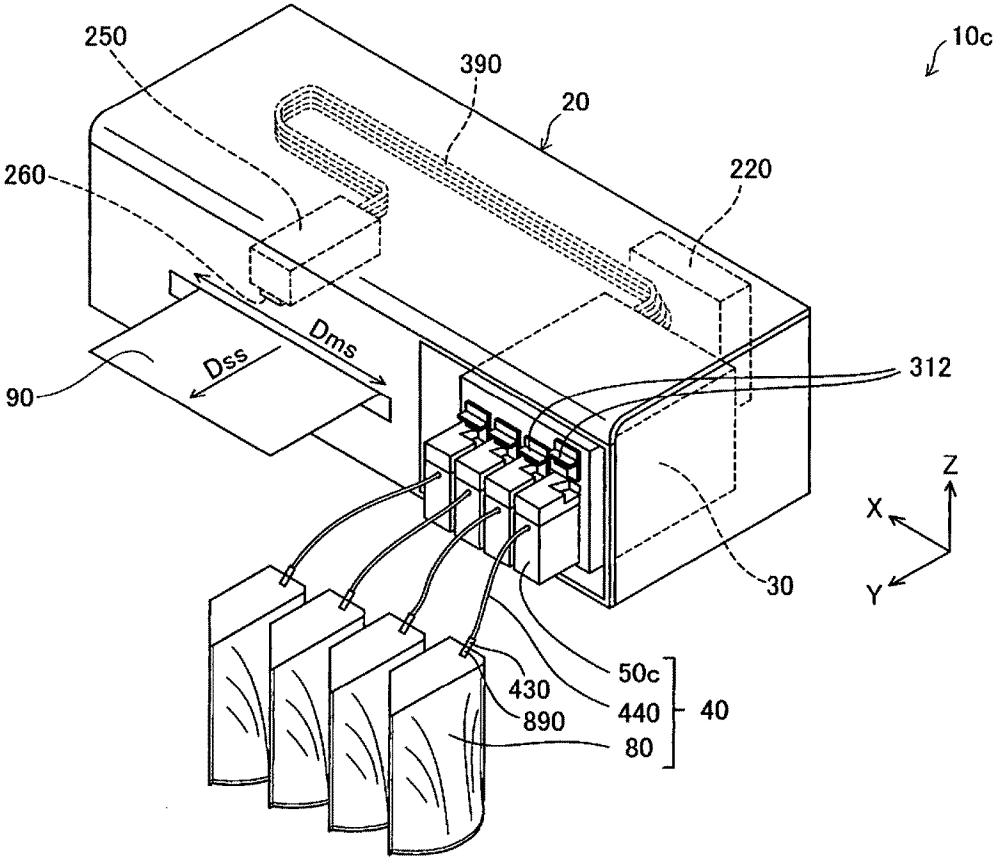
FIG. 18 is a perspective diagram illustrating a configuration of a printing system in a third embodiment.

FIG. 18 is a perspective diagram illustrating a configuration of a printing system 10*c* in a third embodiment. The printing system 10*c* of the third embodiment is provided with the printer 20 and a continuous ink supply system (CISS) 40.

The third embodiment is the same as the first embodiment except for the point that the continuous ink supply system 40 is used instead of the cartridge 50. In the third embodiment, it is possible to apply the same configuration as the first embodiment and the second embodiment including modified examples. In the description of the third embodiment, the same reference numerals are used for the same configuration as the first embodiment and description thereof will be omitted.

The continuous ink supply system 40 of the third embodiment is a system where ink is continuously supplied with regard to the printer 20. The continuous ink supply system 40 is provided with a cartridge 50*c*, an ink container 80, and a flexible tube 440.

The ink container 80 is a vessel which stores ink in an inner section in a sealed state. In the present embodiment, the ink container 80 is a standing pouch which is formed of a flexible member with a thin plate shape which has flexibility in a bag shape so as to be able to stand alone. The ink container 80 has a discharge port 890 which discharges ink from the ink container 80. The discharge port 890 of the ink container 80 is configured so as to be able to be attached and detached with regard to a joining section 430 of the flexible tube 440. In a state where the joining section 430 of the flexible tube 440 is joined to the discharge port 890 of the ink container 80, ink is supplied to the cartridge 50*c* from the ink container 80 through the flexible tube 440.

In the present embodiment, the discharge port 890 of the ink container 80 is configured so as to be sealed in a state of not being joined to the joining section 430 of the flexible tube 440 in the same manner as the ink supply port 680 of the cartridge 50 in the first embodiment. In the present embodiment, the joining section 430 of the flexible tube 440 is configured so as to be sealed in a state of not being joined to the discharge port 890 of the ink container 80 in the same manner as the ink supply mechanism 330 of the holder 30 in the first embodiment.

When replacing the ink container 80, the user of the printing system 10*c* detaches the spent ink container 80 from the flexible tube 440 and joins a new ink container 80 to the flexible tube 440 instead of the spent ink container 80. In the present embodiment, in the same manner as the ink container 70 of the first embodiment, a new circuit member 580 which handles information which relates to ink which is supplied from the ink container 80 belongs to the ink container 80, and the replacement of the circuit member 580 is performed by the user of the printing system 10*c* in combination with the replacement of the ink container 80. The replacement of the circuit member 580 may be before the replacement of the ink container 80 or may be after the replacement of the ink container 80.

Figure 19:
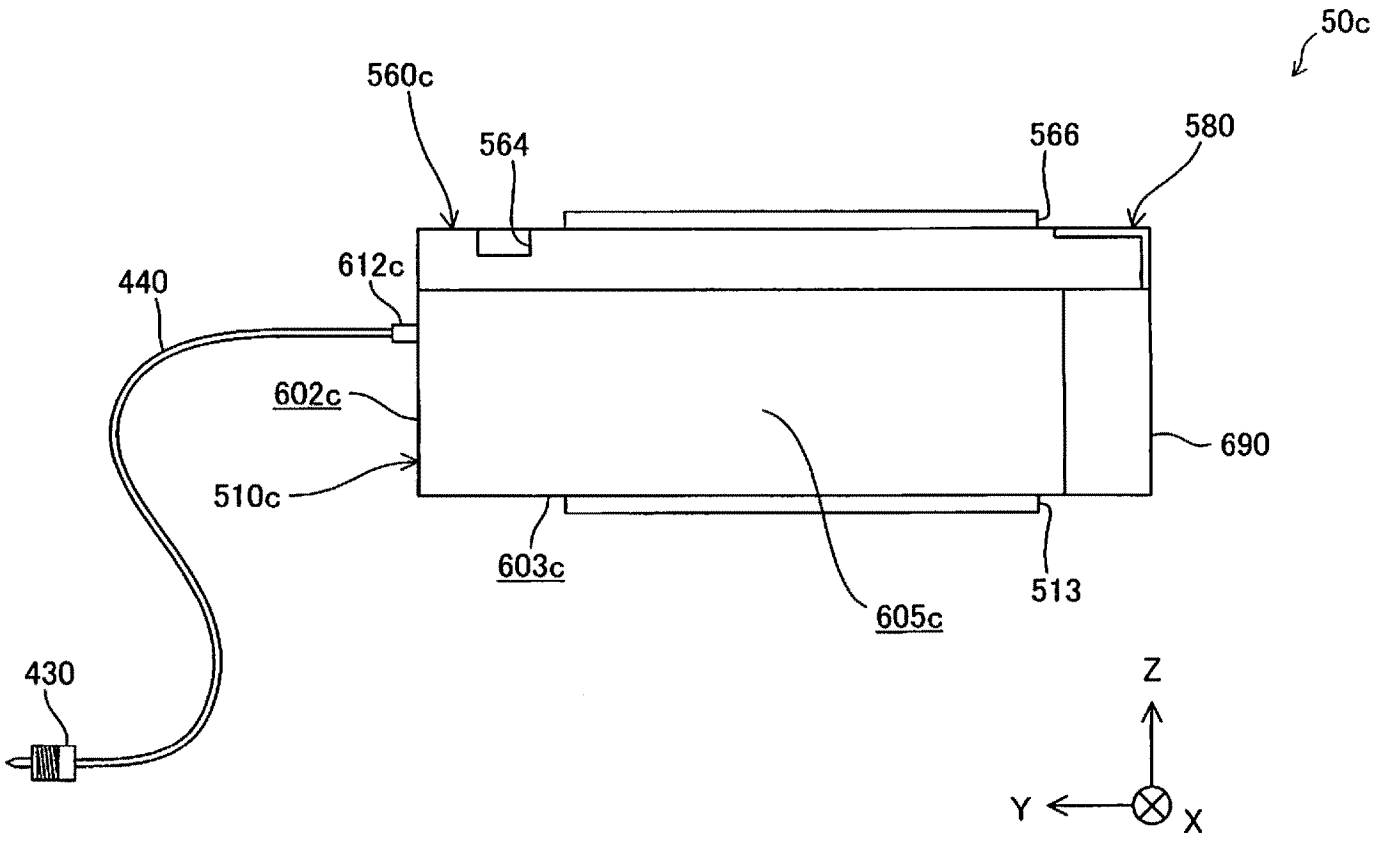
FIG. 19 is a right side surface diagram illustrating a configuration of a cartridge in the third embodiment.
Figure 20:
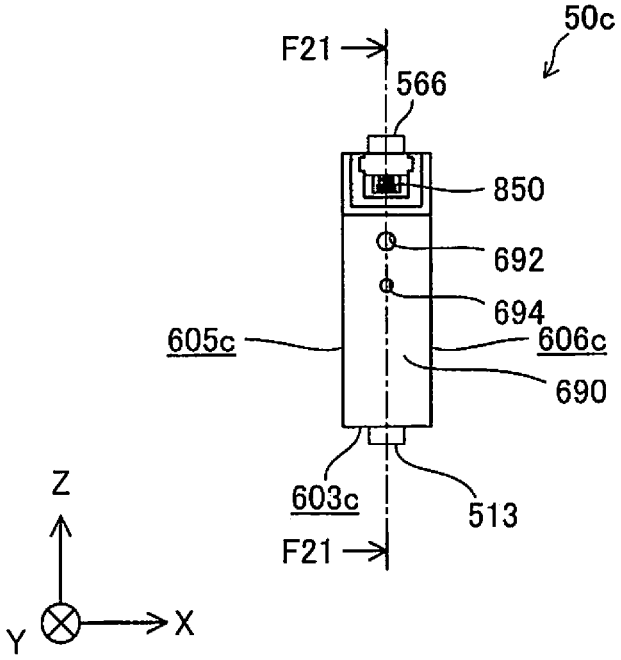
FIG. 20 is a rear surface diagram illustrating a configuration of a cartridge in the third embodiment.

FIG. 19 is a right side surface diagram illustrating a configuration of the cartridge 50*c* in the third embodiment. FIG. 20 is a rear surface diagram illustrating a configuration of the cartridge 50*c* in the third embodiment. The cartridge 50*c* is provided with a housing 510*c*, a slider 560*c*, and the circuit member 580. In the present embodiment, in the cartridge 50*c*, the slider 560*c* is attached at the +Z axis direction side of the housing 510*c* and the circuit member 580 is attached at the −Y axis direction side of the slider 560*c*. The slider 560*c* of the third embodiment is the same as the slider 560 of the first embodiment except for the point that the length in the Y axis direction is short and the point that there is no lid 562.

Figure 21:
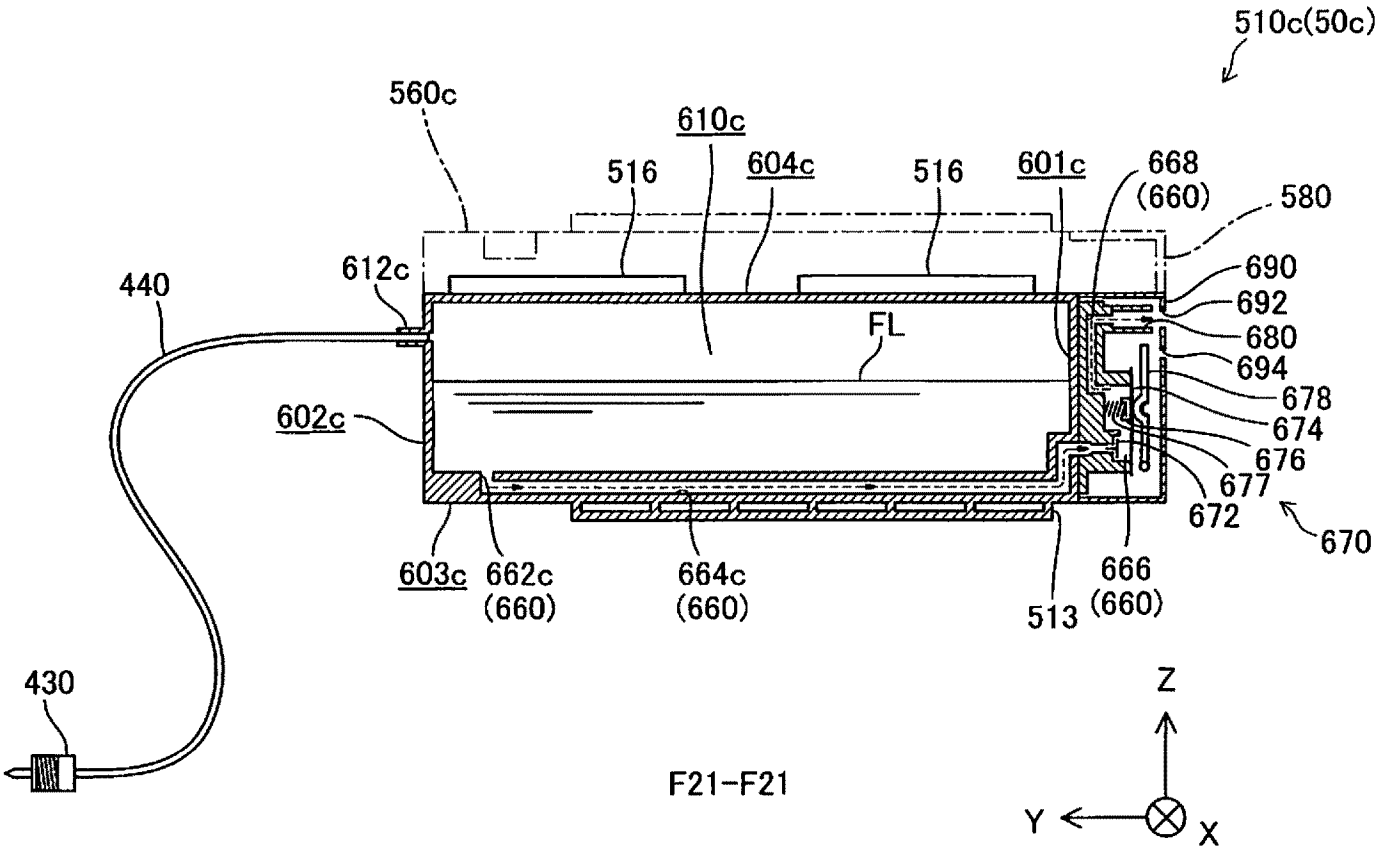
FIG. 21 is a cross sectional diagram illustrating a configuration of a cartridge in the third embodiment.

FIG. 21 is a cross sectional diagram illustrating a configuration of the cartridge 50*c* in the third embodiment. In FIG. 21, the housing 510*c* in the cartridge 50*c* which is a cut away along the arrow line F21-F21 in FIG. 20 is illustrated using a solid line, and the outer shapes of the slider 560*c* and, the circuit member 580 are illustrated using a dashed line.

The housing 510*c* of the cartridge 50*c* forms a shape which is based on an approximately rectangular shape. The shape of an ink storage section 610*c* which is provided in an inner section of the housing 510*c* forms a shape which is based on a rectangle in the same manner as the outer shape of the housing 510*c*. The housing 510*c* and the ink storage section 610*c* are not limited to shapes which are based on a rectangle and may be shapes where a portion is configured by a curved surface or an inclined surface, and it is possible for the housing 510*c* and the ink storage section 610*c* to be appropriately realized using a variety of shapes.

As shown in FIGS. 19 to 21, the housing 510*c* is provided with a first wall surface 601*c*, a second wall surface 602*c*, a third wall surface 603*c*, a fourth wall surface 604*c*, a fifth wall surface 605*c*, and a sixth wall surface 606*c* as wall surfaces which partition the ink storage section 610*c*. As shown in FIG. 21, the ink storage section 610*c* is formed at the inner side of the first to sixth wall surfaces 601*c* to 606*c*.

The first wall surface 601*c* in the third embodiment in the same as the first wall surface 601 in the first embodiment. In the same manner as the first embodiment, the displacement section 670, the ink supply port 680, and the cover 690 are provided at the −Y axis direction side in the first wall surface 601*c*.

The second wall surface 602*c* in the third embodiment is the same as the second wall surface 602 in the first embodiment except for the point that the length of the Z axis direction is different, the point of being adjacent to the third wall surface 603*c* at the −Z axis direction side, and the point that an ink filling port 612*c* is provided. The ink filling port 612*c* of the third embodiment is joined with the flexible tube 440 in a sealed state and receives the ink flow from the ink container 80 through the flexible tube 440. The ink filling port 612*c* is communicating with the ink storage section 610*c*.

The third wall surface 603*c* in the third embodiment is the same as the third wall surface 603 in the first embodiment except for the point that the length in the Y axis direction is different, the point of being adjacent to the second wall surface 602*c* at the +Y axis direction side, and the point that a communication port 662*c* and a flow path 664*c* of the ink flow path 660 are provided. In the same manner as the first embodiment, the convex ridge section 513 is provided at the outer side (the −Z axis direction side) of the third wall surface 603*c*. The communication port 662*c* and the flow path 664*c* of the ink flow path 660 are provided at the inner side (the +Z axis direction side) of the third wall surface 603*c*.

The ink flow path 660 of the third embodiment is the same as the first embodiment except for the point that the ink storage section 610*c* and the ink supply port 680 are linked and for the point that there is the communication port 662*c* and a flow path 664*c* instead of the communication port 662 and the flow path 664. In FIG. 21, the flow of ink from the ink storage section 610*c* via the ink flow path 660 to the ink supply port 680 is illustrated using arrows on a dashed line.

The communication port 662*c* of the third embodiment is the same as the communication port 662 of the first embodiment except for the point of being provided at the third wall surface 603*c* and the point that the float valve 650 is not provided. The flow path 664*c* of the third embodiment is the same as the flow path 664 of the first embodiment except for the point the communication port 662*c* and the flow path 666 are linked. The flow path 664*c* proceeds from the communication port 662*c* with the third wall surface 603 in the −Y axis direction and reaches the flow path 666 via the first wall surface 601.

The fourth wall surface 604*c* in the third embodiment is the same as the fourth wall surface 604 in the first embodiment except for the point that the length in the Y axis direction is different and the point that the ink filling port 612 and the atmosphere opening structure 620 are not provided.

The fifth wall surface 605*c* in the third embodiment is the same as the fifth wall surface 605 in the first embodiment except for the point of forming a shape which is based on a rectangle. The sixth wall surface 606*c* in the third embodiment is the same as the sixth wall surface 606 in the first embodiment except for the point of forming a shape which is based on a rectangle.

In the third embodiment, the inner sections of each of the ink container 80, the flexible tube 440, the ink filling port 612*c*, the ink storage section 610*c*, and the ink flow path 660 are configured so as to be sealed with regard to the atmosphere. These constituent components form a sealed structure where the inner section of the ink flow path 660 is continuously sealed regardless of whether or not the remaining amount of the ink in the ink storage section 610*c* is in the low ink remaining amount state.

In the third embodiment, since the inner section of the ink flow path 660 is continuously sealed with regard to the atmosphere, in a case where the ink storage section 610*c* reaches the low ink remaining amount state, the negative pressure which is generated in the flow path 666 is maintained until the ink is refilled into the ink storage section 610*c* by replacing the spent ink container 80 with the new ink container 80. Due to this, in a case where the ink storage section 610*c* reaches the low ink remaining amount state, the film member 674 of the displacement section 670 is maintained in a state of being depressed in the +Y axis direction as shown in FIG. 10B.

In the present embodiment, the printer 20 detects the situation shown in FIG. 10B using the sensor 376 and determines that the ink storage section 610*c* is in the low ink remaining amount state in a case where the situation which is shown in FIG. 10B continues for a predetermined length of time. In the present embodiment, when it is determined that the ink storage section 610*c* is in the low ink remaining amount state, the printer 20 provides notification to the effect that it is necessary to replace the ink container 80.

According to the third embodiment described above, it is possible to improve the degree of precision for detecting the low ink remaining amount state of the ink while suppressing the complexity of the configuration in the cartridge 50*c* in the same manner as the first embodiment. In addition, in addition to these, it is possible to realize the same effect as the first embodiment, and in cases where modified examples are applied, it is possible to realize the same effects as in cases where modified examples are applied to the first embodiment.

D. Fourth Embodiment

Figure 22:
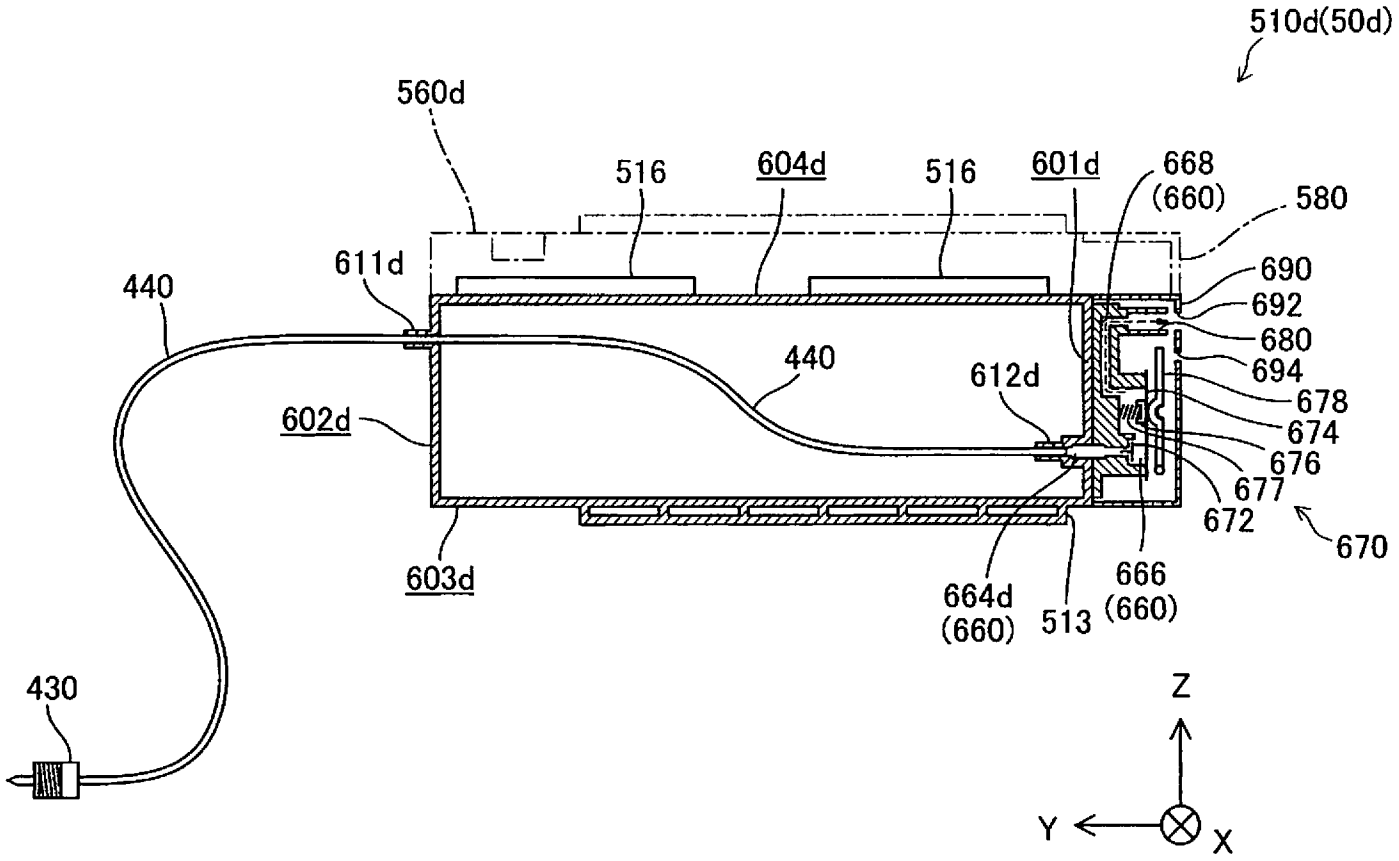
FIG. 22 is a cross sectional diagram illustrating a configuration of a cartridge in a fourth embodiment.

FIG. 22 is a cross sectional diagram illustrating a configuration of a cartridge 50*d* in a fourth embodiment. The fourth embodiment is the same as the third embodiment except for the point that the cartridges 50*d* are used instead of all or a portion of the plurality of cartridges 50*c*. In the fourth embodiment, it is possible to apply the same configuration as the third embodiment including modified examples, with the exception of matters which relate to the ink storage section 610*c*. In the description of the fourth embodiment, the same reference numerals are used for the same configuration as the third embodiment and description thereof will be omitted.

The cartridge 50*d* of the fourth embodiment is the same as the cartridge 50*c* of the third embodiment except for the point that the flexible tube 440 and the ink flow path 660 are directly joined without passing through the ink storage section 610*c*.

A first wall surface 601*d* in the fourth embodiment is the same as the first wall surface 601 in the first embodiment except for the point that an ink filling port 612*d* is provided and the point that a flow path 664*d* of the ink flow path 660 is provided. The ink filling port 612*d* of the fourth embodiment is joined with the flexible tube 440 is a sealed state and receives inflow of the ink from the ink container 80 through the flexible tube 440. The ink filling port 612*d* is linked with the flow path 664*d* of the ink flow path 660.

The ink flow path 660 of the fourth embodiment is the same as the first embodiment except for the point that the ink filling port 612*d* and the ink supply port 680 are linked and the point there is the flow path 664*d* instead of the communication port 662 and the flow path 664. The flow path 664*d* of the ink flow path 660 links between the ink filling port 612*d* and the flow path 666.

The second wall surface 602*d* in the fourth embodiment is the same as the second wall surface 602*c* in the third embodiment except for the point that a through hole 611*d* is provided instead of the ink filling port 612*c*. The through hole 611*d* of the fourth embodiment holds the flexible tube 440 which continues to the ink filling port 612*d* which is positioned in the inner section of a housing 510*d*.

The third wall surface 603*d* in the fourth embodiment is the same as the third wall surface 603*c* in the third embodiment except for the point the ink flow path 660 is not provided. The fourth wall surface 604*d* in the fourth embodiment is the same as the third wall surface 603*c* in the third embodiment.

In the fourth embodiment, the inner sections of each of the ink container 80, the flexible tube 440, the ink filling port 612*d*, and the ink flow path 660 are configured so as to be sealed with regard to the atmosphere. These constituent components form a sealed structure which continuously seals the inner section of the ink flow path 660 regardless of whether or not the remaining amount of the ink in the ink container 80 which functions as the ink storage section of the cartridge 50*d* is in the low ink remaining amount state.

In the fourth embodiment, since the inner section of the ink flow path 660 is continuously sealed with regard to the atmosphere, in a case where the ink container 80 reaches the low ink remaining amount state, the negative pressure which is generated in the flow path 666 is maintained until the spent ink container 80 is replaced with the new ink container 80. Due to this, in a case where the ink container 80 reaches the low ink remaining amount state, the film member 674 of the displacement section 670 is maintained in a state of being depressed in the +Y axis direction as shown in FIG. 10B.

In the present embodiment, the printer 20 detects the situation shown in FIG. 10B using the sensor 376 and determines that the ink container 80 is in the low ink remaining amount state in a case where the situation which is shown in FIG. 10B continues for a predetermined length of time. In the present embodiment, when it is determined that the ink container 80 is in the low ink remaining amount state, the printer 20 provides notification to the effect that it is necessary to replace the ink container 80.

According to the fourth embodiment described above, it is possible to improve the degree of precision for detecting the low ink remaining amount state of the ink while suppressing the complexity of the configuration in the cartridge 50*d* in the same manner as the third embodiment. In addition, in addition to these, it is possible to realize the same effect as the third embodiment, and in cases where modified examples are applied, it is possible to realize the same effects as in cases where modified examples are applied to the third embodiment.

E. Other Embodiments

The present invention is not limited to the embodiments, examples, and modified examples described above and it is possible to realize various configurations in a scope which does not depart from the gist of the present invention. For example, in order to solve a portion or all of the problems described above or in order to achieve a portion or all of the effects described above, it is possible to appropriately substitute or combine the technical characteristics in the embodiments, examples, and modified examples which correspond to the technical characteristics in each of the forms described above in the section of the Summary of Invention. In addition, where the technical characteristics are not described as essential characteristics in the present specification, appropriate omissions are possible.

For example, another electrical device may be mounted into the cartridge instead of the storage apparatus. In addition, it is not necessary to configure each of the various members in the embodiments described above as respective independent members and the various members may be configured as members where a plurality of members are integrated according to necessity. In addition, integrated members in the embodiments described above may be configured by a combination of a plurality of members.

It is possible for the present invention to be applied to an arbitrary liquid ejecting apparatus which ejects liquids other than ink and a liquid storage container thereof without being limited to the ink jet printer and the ink cartridges thereof. For example, it is possible to apply the present invention to the following various types of liquid ejecting apparatuses and liquid storage containers thereof; image recording apparatuses such as facsimile apparatuses, color material ejecting apparatuses which are used in the manufacturing of color filters for image display apparatuses such as liquid crystal displays, electrode material ejecting apparatuses which are used in forming electrodes such as in organic EL (Electro Luminescence) displays or field emission displays (FED), liquid ejecting apparatuses which eject liquids which include biological organic material which is used in bio-chip manufacturing, sample ejecting apparatuses such as precision pipettes, lubricant oil ejecting apparatuses, resin liquid ejecting apparatuses, liquid ejecting apparatuses which eject lubricant oil in precision machines such as watches or cameras in a pin point manner, liquid ejecting apparatuses which eject transparent resin liquid such as ultraviolet curing resin liquid onto substrates in order to form minute hemispherical lenses which are used in optical communication elements or the like, liquid ejecting apparatuses which eject acidic or alkaline etching liquid in order to etch a substrate or the like, and liquid ejecting apparatuses which are provided with liquid ejecting heads which discharge other arbitrary liquid droplets in minute amounts.

Here, "liquid droplets" refers to a state of liquid which is discharged from the liquid ejecting apparatus and also includes liquids which have a thread shaped tail in addition to granular liquids and tear-shaped liquids. In addition, it is sufficient if "liquid" referred to here is a material which is able to be ejected by a liquid ejecting apparatus. For example, it is sufficient if the "liquid" is a material in a state where the substance is a liquid phase, and materials in a liquid state with high or low viscosity and materials in the liquid state such as sols, gel water, other inorganic solvents, organic solvents, solutions, liquid resin, liquid metals (metal melts) are also included as the "liquid". In addition, not only liquids with one state of matter, but liquids where particles of a functional material formed of a solid material such as pigments or metal particles are dissolved, dispersed, or mixed in a solvent are included as the "liquid". In addition, typical examples of the liquid include inks, liquid crystals, and the like as described in the embodiments described above. Here, the inks include typical water-based inks and oil-based inks in addition to various types of liquid compositions such as gel inks and hot melt inks.

According to an aspect of the embodiment, an ink supply apparatus is adapted to supply ink to a printer. The ink supply apparatus includes an ink filling port, an ink storage section, an ink flow path, a displacement section, an ink supply port, and a sealing structure. The ink filling port is configured to receive filling of ink. The ink storage section is communicated with the ink filling port, and configured to store the ink. The ink flow path is communicated with the ink storage section, and configured to allow the ink to flow from the ink storage section. The displacement section defines a portion of the ink flow path, which is displaced according to internal pressure in the ink flow path so as to be detected by the printer. The ink supply port is communicated with the ink flow path for supplying the ink from the ink flow path to the printer. The sealing structure seals an inner section of the ink flow path at least in a low ink remaining amount state where a remaining amount of the ink in the ink storage section is a predetermined amount or less. According to the ink supply apparatus of this aspect, it is possible to detect the low ink remaining amount state in the ink storage section, which is configured such that it is possible for ink to flow in via the ink filling port, at the printer side based on displacement of the displacement section according to the internal pressure in the ink flow path. Due to this, it is possible to improve the degree of precision for detecting the low ink remaining amount state of the ink while suppressing the complexity of the configuration in the ink supply apparatus.

The ink supply apparatus according to the aspect described above may be further provided with a communication port which allows the ink flow path to be communicated with the ink storage section, where the ink storage section may be open to the atmosphere, and the sealing structure may include a buoyancy generating section which is provided in an inner section of the ink storage section and generates buoyancy with regard to the ink in the ink storage section and a valve section which is configured to be able to open and close the communication port according to the buoyancy due to the buoyancy generating section and which blocks off the communication port in the low ink remaining amount state. According to the ink supply apparatus of this aspect, it is possible to block off the communication port and seal the ink flow path using the valve section when the ink storage section reaches the low ink remaining amount state. Due to this, it is possible to perform detection of the low ink remaining amount state based on the displacement of the displacement section according to the internal pressure in the ink flow path even when the ink storage section is opened to the atmosphere.

In the ink supply apparatus according to the aspect described above, the buoyancy generating section may have a plurality of buoyant bodies with a density which is lower than the ink. According to the ink supply apparatus of this aspect, even in a case where a portion of the plurality of buoyant bodies is damaged, it is possible to operate the valve section using other buoyant bodies. Due to this, it is possible to suppress failures to detect the low ink remaining amount state.

In the ink supply apparatus according to the aspect described above, the plurality of buoyant bodies may be aligned along a Z axis direction which is parallel to the direction of gravity in the ink supply apparatus which is mounted into the printer. According to the ink supply apparatus of this aspect, it is possible to reduce changes in the posture of the buoyancy generating section in a case where a portion of the plurality of buoyant bodies is damaged and to suppress operation failure of the valve section compared to a case where the plurality of buoyant bodies are lined up along the horizontal direction. Due to this, it is possible to further suppress failures to detect the low ink remaining amount state.

The ink supply apparatus according to the aspect described above may be further provided with an atmosphere opening port which opens the ink storage section to the atmosphere, where, when a direction toward an opposite side to gravity in the ink supply apparatus which is mounted into the printer is set as a +Z axis direction, an end portion on the +Z axis direction side of the atmosphere opening port may be positioned more to the +Z axis direction side than an end portion on the +Z axis direction side of the ink filling port. According to the ink supply apparatus of this aspect, it is possible for the ink to overflow from the ink filling port prior to the atmosphere opening port in a case where an excessive amount of ink flows into the ink storage section. Due to this, it is possible to prevent blocking between the ink storage section and the atmosphere opening port due to the ink flowing in from the ink storage section to the atmosphere opening port.

The ink supply apparatus according to the aspect described above may be further provided with a communication port which links the ink flow path to the ink storage section, where, when the direction of gravity in the ink supply apparatus which is mounted into the printer is set as a −Z axis direction, the communication port may be provided on a wall surface which partitions the −Z axis direction side of the ink storage section. According to the ink supply apparatus of this aspect, it is possible to supply ink, which is stored in the −Z axis direction side of the ink storage section where the mixing in of foreign material such as dust and air is comparatively small, to the printer.

The ink supply apparatus according to the aspect described above may further be provided with a circuit member which has a circuit board where a connection terminal is formed, a housing where the ink storage section is provided in an inner section, and a sliding member which is configured so that the circuit member is able to be attached and detached and which is configured so as to be able to be attached and detached by sliding with regard to the housing which is mounted into the printer in a state where the circuit member is mounted, where, in a state where the sliding member, where the circuit member is mounted, is mounted into the printer along with the housing, the connection terminal may be electrically connected due to contact with regard to a connection terminal which is provided in the printer, and when a direction where the sliding member is mounted by sliding with regard to the housing is set as the −Y axis direction, the circuit member may be positioned more to the −Y axis direction side than the ink filling port in a state where the sliding member, where the circuit member is mounted, is mounted into the housing. According to the ink supply apparatus of this aspect, it is possible to attach and detach the circuit member in a state where the housing, where the ink storage section is provided, is mounted into the printer while preventing fouling of the circuit board by ink which flows in from the ink inflow port.

The ink supply apparatus according to the aspect described above may be further provided with an atmosphere opening port which is provided in the housing and opens the ink storage section to the atmosphere, where the sliding member may cover the atmosphere opening port in a state of being mounted into the housing. According to the ink supply apparatus of this aspect, it is possible to prevent mixing in of foreign materials from the atmosphere opening port into the ink storage section and the blocking off of the atmosphere opening port due to the foreign material.

The ink supply apparatus according to the aspect described above, where the circuit member may have a position aligning section which positionally aligns the connection terminal with regard to the other connection terminal. According to the ink supply apparatus of this aspect, it is possible to prevent contact failure between the connection terminal on the ink supply apparatus side and the other connection terminal on the printer side.

The ink supply apparatus according to the aspect described above may be further provided with a circuit member which has a circuit board where connection terminal is formed; a housing where the ink storage section is provided in an inner section and is configured so that the circuit member is be able to be attached and detached; a housing side terminal which is provided in the housing and electrically connected due to contact with regard to the connection terminal in the circuit member which is mounted into the housing; and relay wiring which is provided in the housing and relays an electrical connection between the housing side terminal and the other connection terminal which is provided in the printer, where, when a direction toward an opposite side to gravity in the ink supply apparatus which is mounted into the printer is set as a +Z axis direction, the housing side terminal may be positioned more to the +Z axis direction side than the ink filling port. According to the ink supply apparatus of this aspect, it is possible to attach and detach the circuit member in a state where the ink supply apparatus is mounted into the printer while preventing fouling of the circuit board by ink which flows in from the ink filling port.

According to another aspect of the embodiment, an ink supply apparatus, which supplies ink to a printer, is provided. The ink supply apparatus is provided with an ink storage section which stores the ink, an ink flow path which is able to connect to the ink storage section so as to be sealed from the atmosphere, a displacement section which configures a portion of the ink flow path and is displaced according to pressure in the inner section of the ink flow path so as to be able to be detected by the printer, an ink supply port which links to the ink flow path and supplies the ink from the ink flow path to the printer, and a sealing structure which at least seals an inner section of the ink flow path in a low ink remaining amount state where a remaining amount of the ink in the ink storage section is a predetermined amount or less. According to the ink supply apparatus of this aspect, it is possible to detect the low ink remaining amount state in the ink storage section at the printer side based on the displacement of displacement section according to the internal pressure in the ink flow path. Due to this, it is possible to improve the degree of precision for detecting the low ink remaining amount state of the ink while suppressing the complexity of the configuration in the ink supply apparatus.

In the ink supply apparatus of the aspect described above, the ink storage section is provided with an atmosphere opening port. According the ink supply apparatus of this aspect, in a case where the remaining amount of the ink is greater than the predetermined amount, the ink is stably supplied since the inside of ink storage section is linked with the atmosphere and the inside of ink storage section is maintained at the same pressure as the atmosphere. On the other hand, when the remaining amount of the ink in the ink storage section is the predetermined amount or less, the ink inside the ink flow path is reduced and the displacement section is displaced due to the supply of ink from the ink supply port since the ink flow path which is connected to the ink storage section is sealed by the sealing structure. It is possible to detect the low ink remaining amount state in the ink storage section at the printer side based on the displacement of the displacement section. Due to this, it is possible to improve the degree of precision for detecting the low ink remaining amount state of the ink while suppressing the complexity of the configuration in the ink supply apparatus.

According to another aspect of the embodiment, an ink supply apparatus, which supplies ink to a printer, is provided. The ink supply apparatus is provided with an ink storage section which stores the ink, an ink flow path which is connected to the ink storage section so as able to be attached and detached, a displacement section which configures a portion of the ink flow path and is displaced according to pressure in the inner section of the ink flow path so as to be able to be detected by the printer, and an ink supply port which links to the ink flow path and supplies the ink from the ink flow path to the printer, where the ink storage section and the ink flow path are configured to be sealed from the atmosphere when the ink storage section and the ink flow path are connected and the displacement section is displaced in a low ink remaining amount state where a remaining amount of the ink in the ink storage section is a predetermined amount or less. According to the ink supply apparatus of this aspect, it is possible to detach the ink storage section from the ink flow path and replace the ink storage section with an ink storage section with a greater amount of ink in a case where the low ink remaining amount state of the ink is detected. As a result, it is possible to stably supply the ink again.

In the ink supply apparatus of the aspect described above, the ink storage section is arranged outside the printer. According to the ink supply apparatus of this aspect, it is possible to freely set the capacity and location for installing the ink storage section without being limited by the space inside the printer.

According to another aspect of the embodiment, an ink storage container, which supplies ink to a printer, is provided. The ink storage container is provided with an ink supply port which supplies the ink to the printer, an ink flow path which is linked with the ink supply port, a displacement section which configures a portion of the ink flow path and is displaced according to pressure in the inner section of the ink flow path so as to be able to be detected by the printer, and an ink storage section which is detachably connectable to the ink flow path at an upstream side of the displacement section in such a manner as to be sealed from the atmosphere and which is configured so as to be sealed from the atmosphere when connected to the ink flow path. According to the ink storage container of this aspect, it is possible to detach the ink storage section from the ink flow path and replace the ink storage section with an ink storage section with a greater amount of ink in a case where the low ink remaining amount state of the ink inside the ink storage section is detected. As a result, it is possible to stably supply the ink again.

None of the plurality of constituent components which belong to each of the aspects described above is essential, and it is possible to appropriately modify, delete, substitute with other new constituent components, or delete a portion of the limited content with regard to a portion of the plurality of constituent components in order to solve a portion or all of the problems described above or in order to achieve a portion or all of the effects which are described in the present specifications. In addition, it is possible for a portion or all of the technical features which are included in one aspect of the embodiment described above to be combined with a portion or all of the technical features which are included in other aspects of the embodiment described above into a form independent of the embodiment in order to solve a portion or all of the problems described above or in order to achieve a portion or all of the effects which are described in the present specification.

For example, it is possible to realize one aspect of the embodiment as an apparatus which is provided with one or more components from out of six components of an ink filling port, an ink storage section, an ink flow path, a displacement section, an ink supply port, and a sealing structure. That is, the apparatus of the embodiment may or may not have the ink filling port. In addition, the apparatus of the embodiment may or may not have the ink storage section. In addition, the apparatus of the embodiment may or may not have the ink flow path. In addition, the apparatus of the embodiment may or may not have the displacement section. In addition, the apparatus of the embodiment may or may not have the ink supply port. In addition, the apparatus of the embodiment may or may not have the sealing structure.

For example, the ink filling port may be configured as an ink filling port which receives inflow of ink. For example, the ink storage section may be configured as an ink storage section which is linked with the ink filling port and stores ink. For example, the ink flow path may be configured as an ink flow path which is linked with the ink storage section and configured such that it is possible for the ink to flow from the ink storage section. For example, the displacement section may be configured as a displacement section which configures a portion of the ink flow path and is displaced according to the internal pressure in the ink flow path so as to be able to be detected by the printer. For example, the ink supply port may be configured as an ink supply port which is linked with ink flow path and supplies ink from the ink supply path to the printer. For example, the sealing structure may be configured as a sealing structure which at least seals the inner section of the ink flow path in a low ink remaining amount state where the remaining state of the ink in the ink storage section is a predetermined amount or less.

For example, it is possible for such apparatuses to be realized as ink supply apparatuses, but realization as apparatuses other than an ink supply apparatus is also possible. According to such an aspect, it is possible to solve at least one of the various problems such as size reduction, cost reduction, resource saving, ease of manufacturing, improved usability, and the like of the apparatus. It is possible for a portion or all of the technical features of each of the aspects of the ink supply apparatus described above to be applied to any of these apparatuses.

It is possible for the present invention to be realized as various aspects other than an ink supply apparatus. For example, realization is possible as an aspect such as a liquid supply apparatus which supplies a liquid which is different to ink, a printer where the ink supply apparatus is mounted, an ink refill method where the ink is refilled into the ink supply apparatus, a computer program which realizes the ink refill method, or a recording medium where the computer program is recorded in a permanent manner.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An ink supply apparatus for supplying ink to a printer, the printer including a holder provided with an ink receiving part, the ink supply apparatus comprising:

an ink supply passage member connected to the ink receiving part; and an ink container in fluid communication with the ink receiving part through the ink supply passage member, the ink container including an ink discharge port at an upper portion thereof, the ink discharge port being configured to be sealed in a state of not being joined to the ink supply passage member such that the sealed state is maintained when the ink container is replaced with a new ink container, the ink supply passage member including a joining section connectable to the ink discharge port, and the joining section being configured to be sealed in a state of not being connected to the ink discharge port.

2. The ink supply apparatus according to claim 1, wherein the ink container is a pouch having a bottom face.

3. The ink supply apparatus according to claim 2, wherein the ink container is a standing pouch.

4. The ink supply apparatus according to claim 1, wherein the ink supply passage member includes a flexible tube.

5. The ink supply apparatus according to claim 1, wherein the ink container is located outside of the printer.

6. The ink supply apparatus according to claim 5, wherein the holder is located at front side of the printer and the ink container is located outside of the front side of the printer.

* * * * *